US009771181B2

(12) United States Patent
Townsend

(10) Patent No.: US 9,771,181 B2
(45) Date of Patent: Sep. 26, 2017

(54) CONTAINER LINER SYSTEMS

(71) Applicant: ASIATEK, Scottsdale, AZ (US)

(72) Inventor: Arthur M. Townsend, Scottsdale, AZ (US)

(73) Assignee: Asiatek, Scottsdale, AZ (US)

( * ) Notice: Subject to any disclaimer, the term of this patent is extended or adjusted under 35 U.S.C. 154(b) by 0 days.

(21) Appl. No.: 14/391,989

(22) PCT Filed: Apr. 10, 2013

(86) PCT No.: PCT/US2013/035995

§ 371 (c)(1),
(2) Date: Oct. 10, 2014

(87) PCT Pub. No.: WO2013/155195

PCT Pub. Date: Oct. 17, 2013

(65) Prior Publication Data

US 2015/0076166 A1 Mar. 19, 2015

Related U.S. Application Data

(60) Provisional application No. 61/622,397, filed on Apr. 10, 2012.

(51) Int. Cl.
*B65D 25/14* (2006.01)
*B65D 90/04* (2006.01)

(52) U.S. Cl.
CPC ..... *B65D 25/14* (2013.01); *B65D 90/047* (2013.01); *B65D 90/048* (2013.01); *B65D 2590/046* (2013.01)

(58) Field of Classification Search
USPC ..... 220/1.6, 495.05, 495.06, 651–653, 694; 383/105, 119
See application file for complete search history.

(56) References Cited

U.S. PATENT DOCUMENTS

| | | | | |
|---|---|---|---|---|
| 5,193,710 | A | 3/1993 | Podd, Sr. et al. | |
| 5,657,896 | A | 8/1997 | Matias | |
| 2001/0041023 | A1 | 11/2001 | Brown et al. | |
| 2005/0052047 | A1* | 3/2005 | McMahon | B60R 13/01 296/39.1 |
| 2007/0235509 | A1 | 10/2007 | Townsend | |
| 2007/0267410 | A1* | 11/2007 | Mino et al. | 220/1.6 |
| 2009/0159652 | A1* | 6/2009 | Mino et al. | 229/117.27 |
| 2011/0248047 | A1 | 10/2011 | Townsend | |
| 2012/0048847 | A1 | 3/2012 | Mino et al. | |

FOREIGN PATENT DOCUMENTS

| | | | |
|---|---|---|---|
| DE | 26 22 051 | A1 | 12/1976 |
| WO | 2009082766 | A2 | 7/2009 |

OTHER PUBLICATIONS

International Search Report and Written Opinion of the International Searching Authority for PCT/US2013/035995 dated Aug. 15, 2013.

* cited by examiner

*Primary Examiner* — Fenn C Mathew
*Assistant Examiner* — Madison L Poos
(74) *Attorney, Agent, or Firm* — Rodney J. Fuller; Booth Udall Fuller, PLC

(57) ABSTRACT

A shipping container liner system for use in the shipping of bulk flowable products is described. The system comprises a specially adapted shipping container liner that is self-supporting without the need of rear-mounted rigid supportive bars to retain the liner within the shipping container during filling and discharge.

20 Claims, 27 Drawing Sheets

CONTAINER LINER SYSTEMS

CROSS-REFERENCE TO RELATED APPLICATIONS

The present application is the U.S. National Stage of PCT/US2013/035995, filed Apr. 10, 2013, which claims the benefit of U.S. Provisional Application No. 61/622,397, filed Apr. 10, 2012, the contents of each of which are incorporated herein by reference in their entireties for all purposes.

TECHNICAL FIELD

This invention relates to providing systems for improving the operational performance of bulk shipping containers.

BACKGROUND OF THE INVENTION

Container liners are large bag-like structures adapted to fit within the interior of sea containers, truck trailers, and similar cargo-holding enclosures. They are used primarily to provide a clean and safe environment for the bulk transportation of industrial and agricultural products. These products commonly include minerals, powders, plastic pellets, rice, coffee beans, flour and grains, etc.

Typically, the container liner is loosely hung within the interior of the container. The bottom front of the liner is typically secured by a steel bar that slips through a sleeve, centered across the width of the liner, and loops made with strap material, sewn on either side of the liner (in line with the sleeve). The steel bar is then fitted into slots built into both sides of the front of the container. The back of the liner (located at the rear of the container near the access doors) comprises ports and chutes sewn into the upper and lower portions of the line. These ports and chutes are used to fill and discharge cargo. To prevent the liner from deflecting (bulging) out of the back of the container during filling, three to five steel bars are typically hung, in a horizontal position, on the back of the liner. Typically, the steel bars are supported by belt-loops sewn onto both sides of the rear of the utter, proportionally spaced from the top to the bottom. The bar ends are engaged in slots provided on either side of back of the container. These steel bars allow the container doors to be closed after filling, and function to hold the cargo-filled liner inside the container during the discharge of the product.

To discharge the product from the liner, the entire container is typically tipped like a dump truck. During the discharge operation, the steel bars act as a safety shield to prevent the liner from falling out of the container under the considerable weight of the stored cargo. Container liners now require these steel bars to be mounted in the rear of the container prior to filling. They are typically shipped with the container and are discarded after the container is emptied. The economic and environmental cost of using a new set of steel bars with each shipment is substantial.

A further significant problem associated with the use of conventional liners is the inconsistent placement of the liner within the interior of the container. Typically, the lower floor panel within the interior of the liner develops folds as the liner is installed, loaded, and unloaded. Existing liner systems do not provide means for smoothing and flattening the interior of the liner flat prior to use. Furthermore, existing liner systems do not maintain the interior of the liner in a flattened arrangement during product filling and discharge. Folds occurring within the interior of the liner typically slow the discharge of product as the containers are tipped, and often trap portions of the product that remains as residue within the liner.

A similar condition occurs within the discharge hopper as the liner chute develops folds and tears within the hopper's interior during discharge. Typically, this trapped product is lost and discarded along with the liner. In a large, shipment, lost product may amount to several hundred pounds of residue material. Once again, the toss of product during the use of conventional liner systems has both economic and environmental implications.

Clearly, a need exists for improved container liners reducing waste associated with the retention of the liners within the containers Using steel bars and the loss of product due to inconsistent and uneven placement of the liners, within the containers. Furthermore, a need exists for improved discharge hoppers that facilitate rapid and complete discharge of materials.

SUMMARY OF THE INVENTION

In an embodiment, the disclosure relates to a system and apparatus for containing and controlling a flowable material within the interior of a cargo container that may comprise a separating enclosure adapted to separately enclose substantially an entire volume of an interior of the cargo container. The separating enclosure comprises an interior chamber adapted to contain the flowable material within the separating enclosure. The interior chamber comprises a substantially vertical rear-boundary wall, a substantially vertical front-boundary wall, a substantially vertical first sidewall, a substantially vertical second sidewall, and a deflection limiter adapted to limit deflection of the substantially vertical rear-boundary-wall under a load imposed by the flowable material during containment within the separating enclosure and further adapted to guide flowable material towards a center of the substantially vertical rear-boundary-wall during discharge. The deflection limiter comprises at least four load transfer members coupled to the substantially vertical rear-boundary wall at four separated locations, the at least four load transfer members each comprising a first member side coupled to the substantially vertical rear-boundary wall, a second member side, and at least a third member side.

Particular embodiments may comprise one or more of the following features. The at least four load transfer members comprise two inner load transfers members and two outer load transfer members, the two inner transfer members are coupled to the substantially vertical rear-boundary wall at two separate locations between the two outer load transfer members. A first outer load transfer member of the two outer load transfer members is coupled to the substantially vertical first side wall, a first inner load transfer member of the two inner load transfer members is coupled to the substantially vertical first side wall, a second outer load transfer member of the two outer load transfer members is coupled to the substantially vertical second side wall, and a second inner load transfer member of the two inner load transfer members is coupled to the substantially vertical second side wall. The first inner load transfer member and the first outer load transfer member are coupled to the substantially vertical first side wall at different locations, and the second inner load transfer member and the second outer load transfer member are coupled to the substantially vertical second side wall at different locations. Each of the at least four load transfer members is substantially rectangular in shape. At least two of the at least four load transfer members are substantially trapezoidal in shape and comprise a first member side, a second member side, a third side, and a fourth side parallel to the third side. Four of the at least four load transfer members are substantially trapezoid in shape and comprise a first member side, a second member side, a third side, and a fourth side parallel to the third side, and the second member side of each of the at least four load transfer member contacts a substantially horizontal bottom sidewall of the interior chamber. Each of the four load transfer members is substantially perpendicular to the rear-boundary wall. The two inner load transfer members are substantially trapezoidal in shape, the first member side of each of the inner load transfer members is coupled to the substantially vertical rear-boundary wall, the second member side of each of the inner load transfer members contact a substantially horizontal bottom sidewall of the interior chamber, and the two outer load transfer members are substantially rectangular in shape. The two inner load transfer members are substantially perpendicular to the rear-boundary wall, a first outer load transfer member of the two outer load transfer members is coupled to the first side wall, and a second outer load transfer member of the two outer load transfer members is coupled to the second side wall. The two inner load transfer members are smaller in size relative to the two outer load transfer members. The second member side of a first inner load transfer member of the two inner load transfer members is connected to the second member side of a first outer load transfer member of the two outer load transfer members, and the second member side of a second inner load transfer member of the two inner load transfer members is connected to the second member side of a second outer load transfer member of the two outer load transfer members. The first inner load transfer member and the first outer load transfer member are further coupled to the first sidewall, and the second inner load transfer member and the second outer load transfer member are further coupled to the second sidewall.

In another embodiment, the disclosure relates to a system and apparatus for containing and controlling a flowable material within the interior of a cargo container that may comprise a separating enclosure adapted to substantially enclose an entire volume of an interior of the cargo container, and a plurality of load transfer members including first ends coupled along a width of a substantially vertical rear-boundary wall and comprising substantially equal spacing between the first ends.

Particular embodiments may comprise one or more of the following features. The plurality of load transfer members limits deflection of the rear-boundary-wall to less than about 0.2 meters. The plurality of load transfer members comprises four load transfer members comprising second ends opposite the first ends that are coupled to the separating enclosure to prevent deflection of the rear-boundary-wall. The plurality of load transfer members comprises two outer load transfer members comprising second ends coupled to opposing substantially vertical sidewalls. The plurality of load transfer members further comprises two inner load transfer members comprising second ends coupled to a substantially horizontal bottom sidewall. The four load transfer members comprise a substantially rectangular profile and contact no more than two boundary walls when containing and controlling the flowable material. The plurality of load transfer members further comprises two outer load transfer members comprising second ends coupled to the substantially horizontal bottom sidewall. A cross strap is coupled near a front boundary-wall opposite the rear-boundary wall. A back strap comprising support loops is coupled to the rear-boundary wall. A strap comprising support loops is coupled to a substantially horizontal upper containment panel and coupled to a front boundary-wall opposite the rear-boundary wall. The plurality of load transfer members comprises first and second load transfer members comprising second ends opposite the first ends that are coupled to a first sidewall of the separating enclosure, third and fourth load transfer members comprising second ends opposite the first ends that are coupled to a second sidewall of the separating enclosure, and a fifth load transfer member comprising a second end coupled to a substantially horizontal lower containment panel.

In another embodiment, the disclosure relates to a system and apparatus for containing and controlling a flowable material within the interior of a cargo container that may comprise a separating enclosure adapted to substantially enclose an entire volume of an interior of the cargo container, and a plurality of load transfer members comprising first ends coupled along a width of a substantially vertical rear-boundary wall and further comprising second ends coupled to the separating enclosure to prevent deflection of the rear-boundary-wall.

BRIEF DESCRIPTION OF THE DRAWINGS

Illustrative and exemplary embodiments of the invention are shown in the drawings in which.

Figure 1:
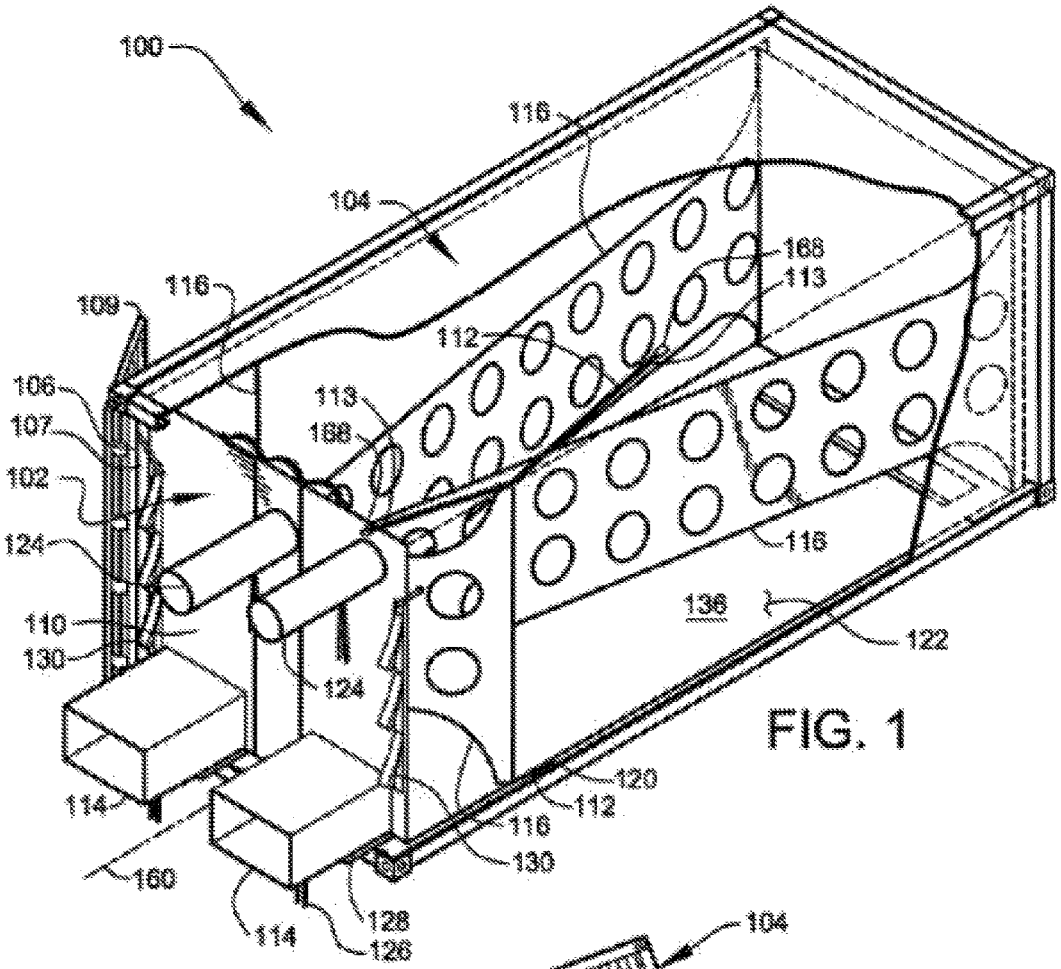
FIG. 1 shows a perspective view, in partial section, illustrating a container liner of a container liner system installed within a shipping container according to an embodiment of a container liner system.

Elements and facts in the figures are illustrated for simplicity and have not necessarily been rendered according to any particular sequence or embodiment.

DETAILED DESCRIPTION OF THE INVENTION

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts.

Figure 2:
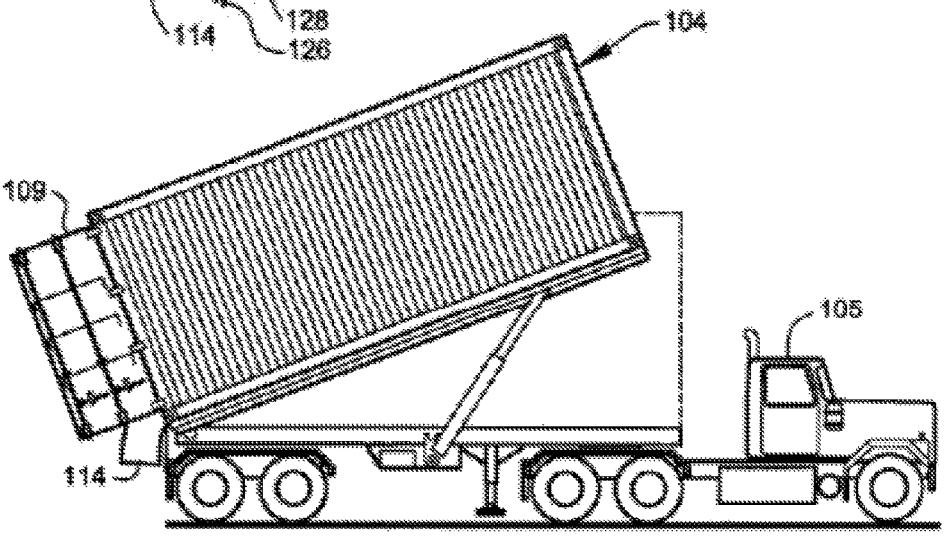
FIG. 2 shows a side view of the shipping container of FIG. 1 in a raised discharge position according to an embodiment of a container liner system.

FIG. 1 shows a perspective view, in partial section, illustrating container liner 102 of container liner system 100 installed within shipping container 104 according to a preferred embodiment of the present invention. FIG. 2 shows a side view of shipping container 104 of FIG. 1 in a raised discharge position according to a preferred embodiment of the present invention.

In an embodiment, container liner 102 comprises a large bag-like structure that generally matches the volume and shape of interior 106 of shipping container 104, as shown. As discussed herein, shipping container 104 is a hypothetical example of a substantially rigid box-like container used in material transport, including cargo containers conforming to International Organization for Standardization (ISO) criteria. In some embodiments, shipping container 104 does not form a part of the present invention. Typically, such containers comprise a rectangular volume having a length that is substantially greater than the height and width, as shown. Typically, such containers are adapted to be loaded and conveyed on container ships, railroad cars, and overland trucks. By way of example only and not limitation, containers may comprise five standard lengths, such as 20 ft (6.1 m), 40 ft (12.2 m), 45 ft (13.7 m), 48 ft (14.6 m) and 53 ft (16.2 m). Container capacity is often measured in twenty-foot equivalent units 17 (TED). A twenty-foot equivalent unit is a measure of containerized cargo capacity equal to one standard 20 ft (length)×8 ft (width)×8.5 ft (height). "High cube" containers have a height of 9.5 ft (2.9 m), while half-height containers, which are generally used for heavy loads, have a height of 4.25 ft (1.3 m). The interior 106 of shipping container 104 is typically accessed through rear opening 107, as shown. Typically, rear opening 107 is secured by a pair of swinging doors 109, as shown.

In the embodiment illustrated in FIG. 1 through FIG. 10, shipping container 104 comprises a standard 20 ft (6.1 m) length, as shown. Other highly preferred embodiments are adapted to fit alternate container configurations, preferably 40 ft. (12.2 m) shipping containers, as described below. Container liner 102 may be adapted to fit within interior 106 of shipping container 104, as shown. When so installed, container liner 102 may be adapted to provide a secondary storage enclosure separating flowable material 108 from the interior 106 of shipping container 104. This provides a clean and safe environment for the bulk transportation of flowable material 108, as shown.

In a particular embodiment, the structures and features of container liner 102 (at least embodying herein at least one separating enclosure adapted to separately enclose the flowable material within the cargo container) are substantially symmetrical about longitudinal line 160, thus, arrangements and features identified within the visible side of the perspective views are applicable to complementary features and arrangements located at the opposite side. The container liner 102 may be secured firmly within interior 106 of shipping container 104 using a distributed arrangement of external tie-down straps 112, as shown (at least embodying herein at least one anchor adapted to anchor the separating enclosure within the interior, and at least embodying herein a external load-transfer-member adapted to transfer a load between the separating enclosure and the cargo container). This arrangement divides loads imposed on container liner 102 between multiple anchor points within shipping container 104, as shown.

Figure 6:
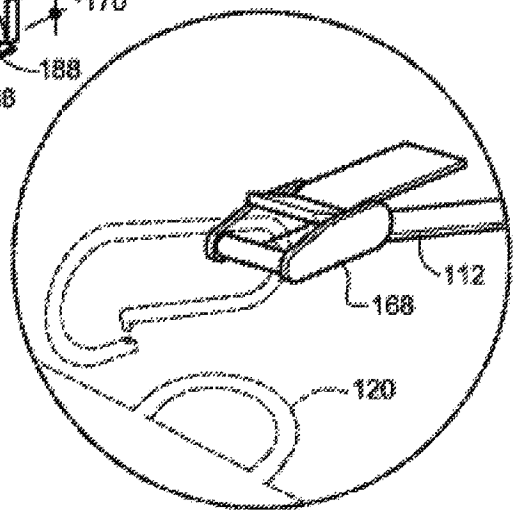
FIG. 6 shows the detailed view 6-6 of FIG. 5A.

In an embodiment, the distal ends 113 of tie-down straps 112 comprise a strap tensioning device, such as but not limited to a strap tensioning buckle 168 (see FIG. 6). Buckle 168 is adapted to receive a removable anchor device, such as a spring-gated hook or carabineer, which may be supplied as a component of container liner system 100, or as an accessory item that is separately sourced. The anchor device may couple tie-down straps 112 to anchor points 120 of shipping container 104, as shown. Such anchor points typically comprise metal loops or apertured plates welded at various points within interior 106, as shown. Coupling the multiple tie-down straps 112 to multiple anchor points 120 within shipping container 104 distributes the cargo load substantially evenly along the length of container liner 102, as shown (at least embodying herein the external load-transfer-member comprises a load divider adapted to assist in dividing the transfer of the load between a plurality of supports within the cargo container).

Figure 3:
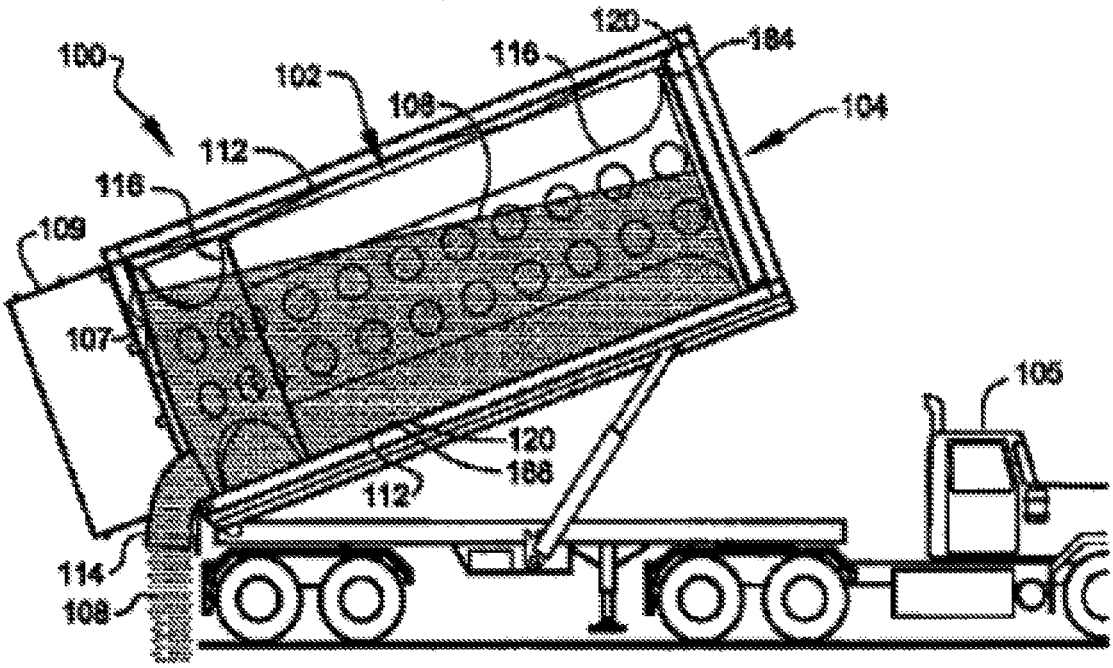
FIG. 3 shows the side view of FIG. 2, in partial section, illustrating the container liner in the process of discharging contained material according to the embodiment of FIG. 1.

Discharge of flowable material 108 from container liner 102 generally involves tipping of shipping container 104, as shown in FIG. 2 and FIG. 3 of the disclosure. Typically, an articulating support assembly of transport vehicle 105 raises shipping container 104, as shown, shifting flowable material 108 toward discharge chutes 114 located at the rear boundary containment wall, identified herein as rear bulkhead wall 110 (at least embodying herein a substantially vertical rear-boundary-wall). Tie-down straps 112 securely maintain container liner 102 within interior 106 during the tipping and discharge operation in the embodiment shown.

A problem significant within poorly supported container liners is residual product trapped within the liner after discharge. This problem is most frequently the result of the bottom of the liner curling, overlapping and/or creasing during product loading. The result is slow discharge rates and, in many cases, several thousand pounds of residual product remaining trapped inside interior 106 of container liner 102. Residual material is typically removed by hand or discarded with container liner, at significant expense.

An embodiment of container liner 102 is adapted to reduce the occurrence of folds and creases within lower containment panel 136 (at least embodying herein a substantially horizontal lower-containment-panel) when container liner 102 is installed, loaded, and unloaded. This system feature is enabled by arranging a plurality tie-down straps 112 along the periphery of lower containment panel 136, each tie-down strap 112 connected to an anchor point 120 within interior 106. Each lower tie-down strap 112 may comprise a strap-tensioning buckle 168 that allows an installer to adjustably tension the anchor straps to draw lower containment panel 136 into a substantially flat plane during installation. Preferably, lower tie-down straps 112 are adapted to maintain lower containment panel 136 in such a flattened configuration during tipping and discharge of flowable material 108 from container liner 102, as shown. This feature greatly increases the rate at which flowable material 108 is discharged. Furthermore, this arrangement greatly reduces the amount of flowable material 108 trapped within the interior of the liner, saving both time and money for the operators of the discharge sites (at least embodying herein wherein the substantially horizontal lower-containment panel comprises a peripheral edge; the peripheral edge comprises the strap; and such tensioning of the strap by the tensioner assists in drawing the substantially horizontal lower containment-panel substantially within a single geometric plane, whereby discharge of the flowable material from the interior chamber is assisted by the positioning of the substantially horizontal lower-containment-wall substantially within such single geometric plane). Thus, in accordance with embodiments of the present invention, there is provided, relating to shipping container liner systems, the above described method related to the efficient discharge of a bulk flowable-material from within the cargo container, comprising the steps of: providing within the cargo container, at least one liner material adapted to separately enclose the bulk flowable-material within the cargo container, wherein the liner material comprises a substantially flexible floor panel; anchoring the separating enclosure within the interior using an anchor strap, tensioning the anchor strap to draw the substantially flexible floor panel substantially within a single geometric plane, whereby discharge of the flowable material from the separating enclosure is assisted by the positioning of the substantially flexible floor panel substantially within such single geometric plane.

Specific reference is now made to FIG. 3 with continued reference to FIG. 1 and FIG. 2. FIG. 3 again illustrates the side view of FIG. 2, now depicted in partial section, as shown. FIG. 3 diagrammatically illustrates container liner 102 in the process of discharging flowable material 108.

It is common for the bulk weight of flowable material 108 to exceed forty thousand pounds. This weight generates considerable loading on the containment boundaries of container liner 102. In most applications, the inner wall surfaces of shipping container 104 assist in supporting this load, however, rear bulkhead wall 110, which may be located adjacent rear opening 107, is substantially unsupported by an interior wall of shipping container 104 (as swinging doors 109 are opened for filling, inspection, discharge, etc.). Additional structural support may therefore be required at rear bulkhead wall 110. To prevent excessive deflection (bulging), or rupture of rear bulkhead wall 110 under the force of this load, container liner 102 comprises a novel arrangement of supportive internal baffles 116, as shown in FIGS. 1-10 and FIGS. 27-30. The internal baffles 116 may function to limit outward deflection by transferring a substantial portion of the load applied to rear bulkhead wall 110 to other vertical walls within the forward portion of container liner 102, as shown (at least embodying herein wherein the load transfer member does not intersect the substantially horizontal lower containment-panel). This transfer of force is especially important during tipping and discharge, when the loading at rear bulkhead wall 110 is greatest. Such a support arrangement preferably eliminates the need for conventional steel restraint bars currently required with existing liners.

Figure 4:
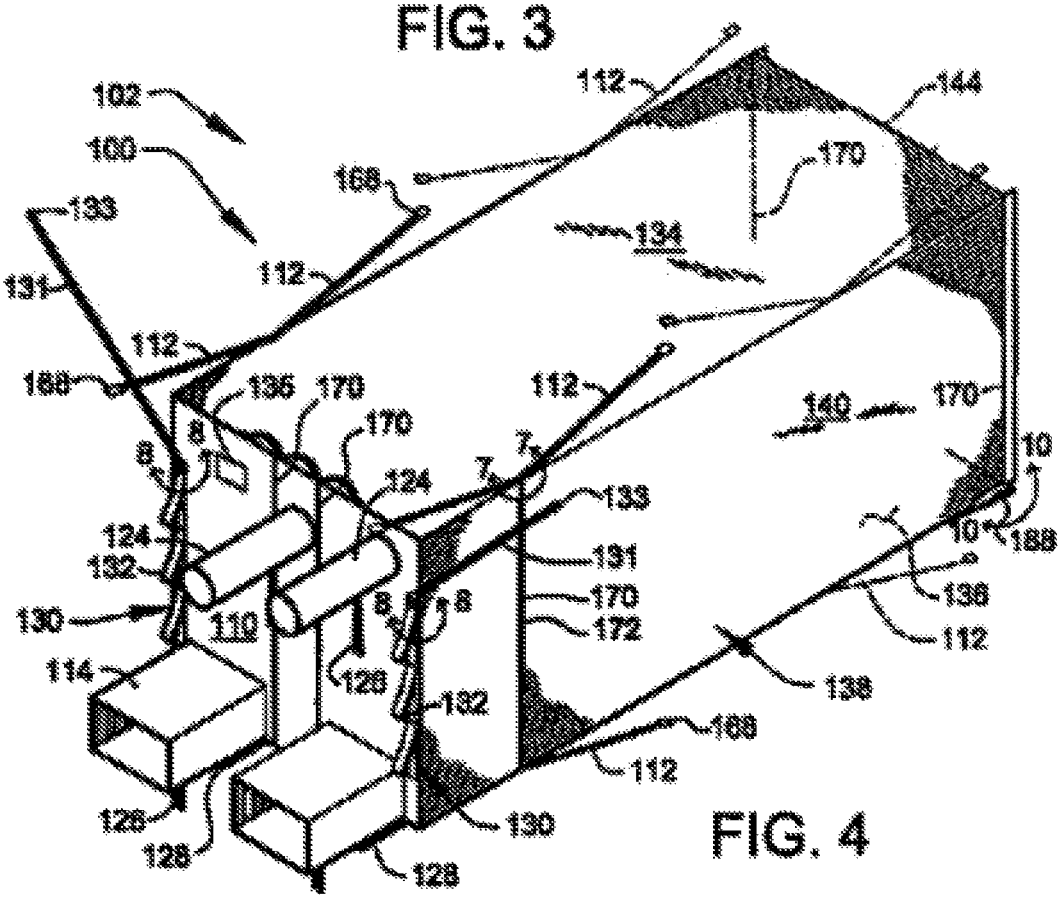
FIG. 4 shows a perspective view illustrating preferred external features of the container liner according to the embodiment of FIG. 1.

FIG. 4 shows a perspective view illustrating preferred external features of container liner 102 according to the embodiment of FIG. 1. The shape and size of container liner 102 generally resembles a rectangular prism, closely matching the rectangular internal volume of interior 106. Container liner 102 may fill substantially the entire interior volume of shipping container 104, as shown. Upon reading the teachings of this specification, those of ordinary skill in the art will now understand that, under appropriate circumstances, considering such issues as shipping container shape, intended use, etc., other geometric liner shapes, such as hollow cylindrical shapes, cube shapes, complex shapes formed to fit within special purpose containers, etc., may suffice.

Container liner 102 may further comprise a rear bulkhead wall 110; upper containment panel 134 (at least embodying herein a substantially horizontal upper-containment panel), lower containment panel 136 (see FIG. 5A), and an arrangement of forward containment walls 138 (at least embodying herein a substantially vertical forward-boundary wall and at least embodying herein a substantially vertical front boundary-wall). The forward containment walls 138 may comprise right sidewall 140, left sidewall 142 (at least embodying herein a substantially vertical side-boundary-wall), and forward bulkhead 144, as shown.

In an embodiment, rear bulkhead wall 110, upper containment panel 134, lower containment panel 136, and forward containment walls 138 are permanently inter-joined to form a substantially unitary enclosure comprising an interior chamber suitable for holding one or more flowable materials 108 (at least embodying herein wherein the separating enclosure comprises a interior chamber adapted to contain the flowable material within the separating enclosure, and wherein both the substantially vertical rear-boundary-wall and the substantially vertical forward boundary-wall adjoin the substantially horizontal upper-containment-panel and the substantially horizontal lower-containment-panel). The rear bulkhead wall 110 may comprise an arrangement of passages adapted to provide access to interior chamber 122 of container liner 102 (see FIG. 5A below). The rear bulkhead wall 110 may further comprise at least one upper fill chutes 124 and at least one lower discharge chutes 114, as shown.

Upper fill chutes 124 may be used to fill interior chamber 122 with flowable material 108, while lower discharge chutes 114 may be used to discharge flowable material 108 from interior chamber 122. Upper fill chutes 124 and lower discharge chutes 114 are typically constructed of a material similar to that of container liner 102. Upper fill chutes 124 and lower discharge chutes 114 may be permanently joined to rear bulkhead wall 110, as shown. In some embodiments, both upper fill chutes 124 and lower discharge chutes 114 comprise a closure device, comprising chute ties 126 that are adapted to tie-off and seal the chutes during transport. In addition, port covers 128 are provided as a protective cover for lower discharge chutes 114 during transport. Some embodiments of rear bulkhead wall 110 comprise additional features, such as inspection port 135 to assist inspection of interior chamber 122, as shown. Upon reading the teachings of this specification, those of ordinary skill in the art will now understand that, under appropriate circumstances, considering such issues as intended use, cargo type, etc., other bulkhead arrangements, such as, for example, full access doors, identification indicia, tracking devices/monitors, etc., may suffice. In existing liners, the size and placement of chutes are limited by the need to support the rear wall with a plurality of horizontal bars. By eliminating the bar supports, container liner system 100 provides a greater number of potential chute configurations. Both upper fill chutes 124 and lower discharge chutes 114 may comprise physical dimensions most appropriate to facilitate loading and unloading of most bulk cargos. For example, both upper fill chutes 124 and lower discharge chutes 114 of example container liner 102 comprise a projecting length of about one meter (m) (about 39 inches). For purposes of example only, upper fill chutes 124 comprise a diameter of about 300 cm, while lower discharge chutes 114 comprise a width dimension of about 750 cm and a height dimension of about 450 cm.

Upon reading the teachings of this specification, those of ordinary skill in the art will now understand that, under appropriate circumstances, considering such issues as intended use, cost, nature of cargo, etc., other chute arrangements, such as, for example, alternate quantities, shapes, sizes, etc., may suffice. Furthermore, upon reading the teachings of this specification, those of ordinary skill in the art will now understand that, under appropriate circumstances, considering such issues as intended use, container design, nature of cargo, etc., other chute locations, such as, for example, providing fill chutes located within the top of the liner, side, front bulkhead, etc., may suffice.

In a particular embodiment, bar support loops 132 are formed as three elastic loops that are centered over rear bulkhead wall 110, as shown. Preferably, the elastic loops function as upper rear supports to assist in maintaining proper positioning of bulkhead wall 110. Preferably, elastic loops are formed from a band of elastic webbing permanently attached, most preferably sewn to the upper peripheral edge of upper containment panel 134, as shown.

Although container liner 102 does not require the use of rear horizontal support bars, accommodations are provided for their use. Rear bulkhead wall 110 may comprise a set of looped bar straps 130 adapted to support the conventional use horizontal support bars (at least embodying herein wherein the separating enclosure further comprises a restraint-bar supporter adapted to assist in supporting a restraint bar in a position assisting restraint of the substantially flexible material against movement). This feature permits the use of container liner system 100 where rules and regulations demand the use of bars, or during the transporting of cargo having an unusually heavy weight. Bar support loops 132 of looped bar straps 130 may be purposefully extended in length to span the distance between rear bulkhead wall 110 and the bar-end engagement slots located adjacent rear opening 107.

Figure 8:
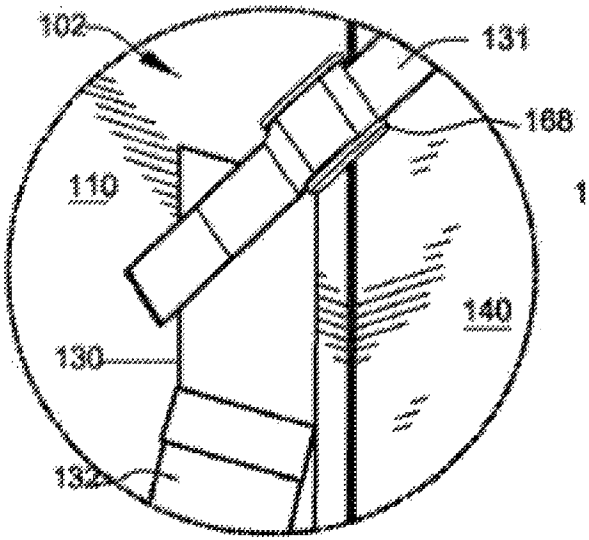
FIG. 8 shows the detailed view 8-8 of FIG. 5A.

Referring to detailed view 8-8 of FIG. 8, container liner 102 comprises an additional set of rear tie-straps 131, as shown. A single rear tie-strap 131 may be permanently attached, sometimes sewn, to the upper end of the right and left looped bar straps 130, as shown. Each rear tie-strap 131 may comprise a strap-tensioning buckle 168, as shown (at least embodying herein wherein the strap comprises a tensioner adapted to generate a tensional force between the first strap-end and such at least one second strap end). The distal end 133 of each rear tie-strap 131 may be provided with a loop adapted to receive a removable anchor device such as a spring-gated hook or carabineer (which may be supplied as a component of container liner system 100, or as an item that is separately sourced). In an embodiment, the anchor device firmly couples each rear tie-strap 131 to an anchor point 120 within shipping container 104. In such an embodiment, the rear tie-strap 131 functions to adjustably support the positioning of looped bar straps 130 and to further assist in controlling the shape, deflection, and support of fear bulkhead wall 110, as shown.

Figure 5B:
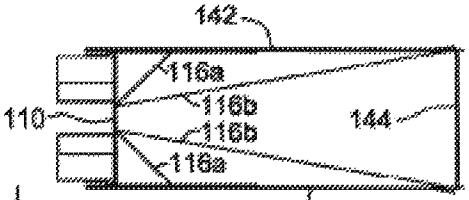
FIG. 5B shows a top view, in partial section, of the container liner in FIG. 1, illustrating internal features and arrangements.
Figure 5A:
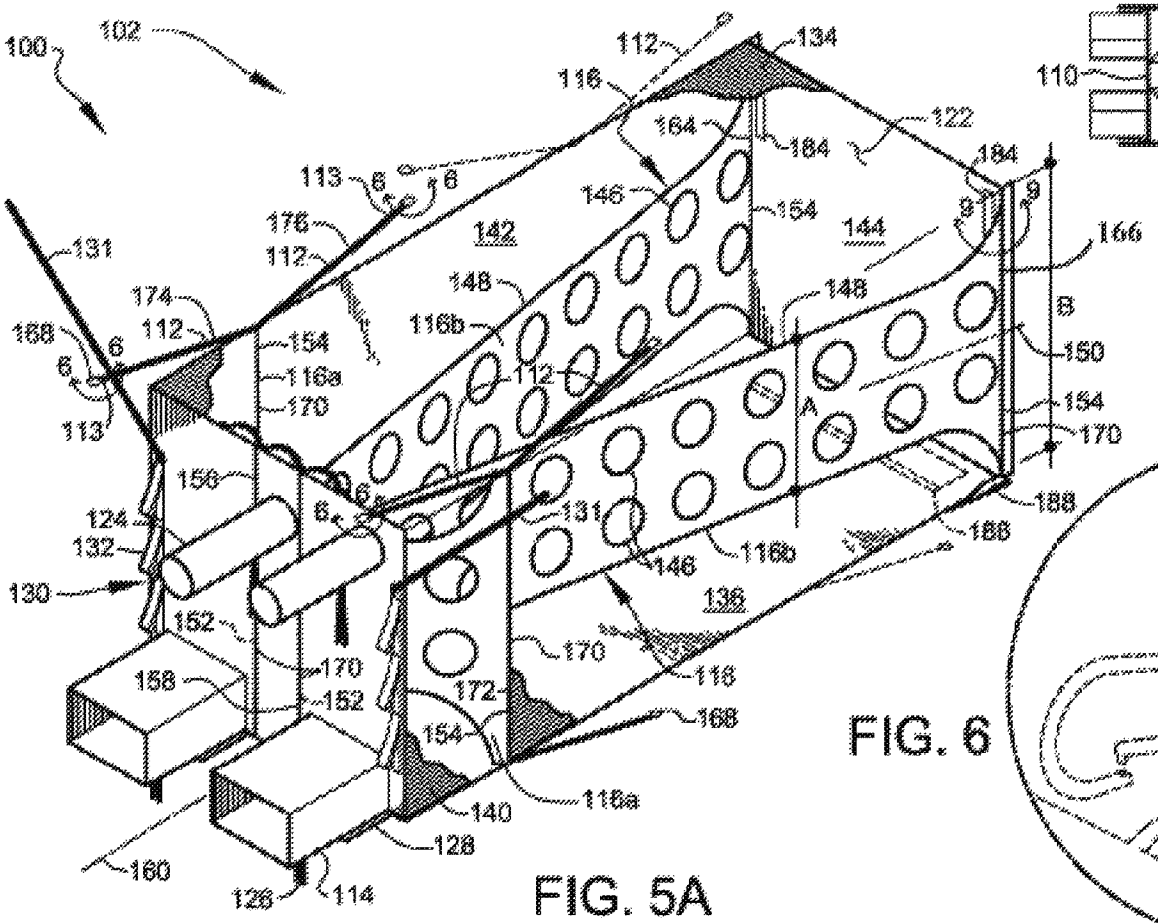
FIG. 5A shows a perspective view, in partial cutaway, of the container liner in FIG. 1, illustrating internal features and arrangements.

FIG. 5A shows a partial cutaway perspective view of container liner 102, illustrating preferred internal features and arrangements of container liner 102. FIG. 5B shows a top view, in partial section, of container liner 102 of FIG. 1. Upper containment panel 134 and right sidewall 140 have been deleted from the view to assist in clearly depicting the preferred interior arrangements of container liner 102.

As previously described, in a particular embodiment internal baffles 116 function as force transfer members to transfer loads from rear bulkhead wall 110 to points within vertically oriented forward containment walls 138, as shown. Each internal baffle 116 may comprise a flexible panel having an extended length and substantial width, as shown. Each internal baffle 116 may further comprise an elongated planar panel that is generally symmetrical about longitudinal axis 150, as 26 shown (at least embodying herein a deflection limiter adapted to limit deflection of the substantially vertical rear-boundary wall under a load imposed by the flowable material during such containment within the separating enclosure, wherein the deflection limiter comprises a load transfer member adapted to transfer at least one direct line of tensional force between the substantially vertical rear-boundary-wall and the substantially vertical forward boundary-wall).

In an embodiment, mid portion 148 of internal baffle 116 comprises a substantially uniform width, as shown. Therein, each end of internal baffle 116 terminates by sweeping away from longitudinal axis 150 along opposing arcs to terminate in wide attachment ends identified herein as attachment end 152 and attachment end 154 (at least embodying herein wherein such at least one load transfer member comprises a rear-boundary-wall end and a forward-boundary-wall end). Mid-portion 148 may comprise a vertical width A equal to about one half the interior height B of interior 106, as shown. Attachment ends 152 may each comprise a width about equal to interior height B, as shown.

Figure 15:
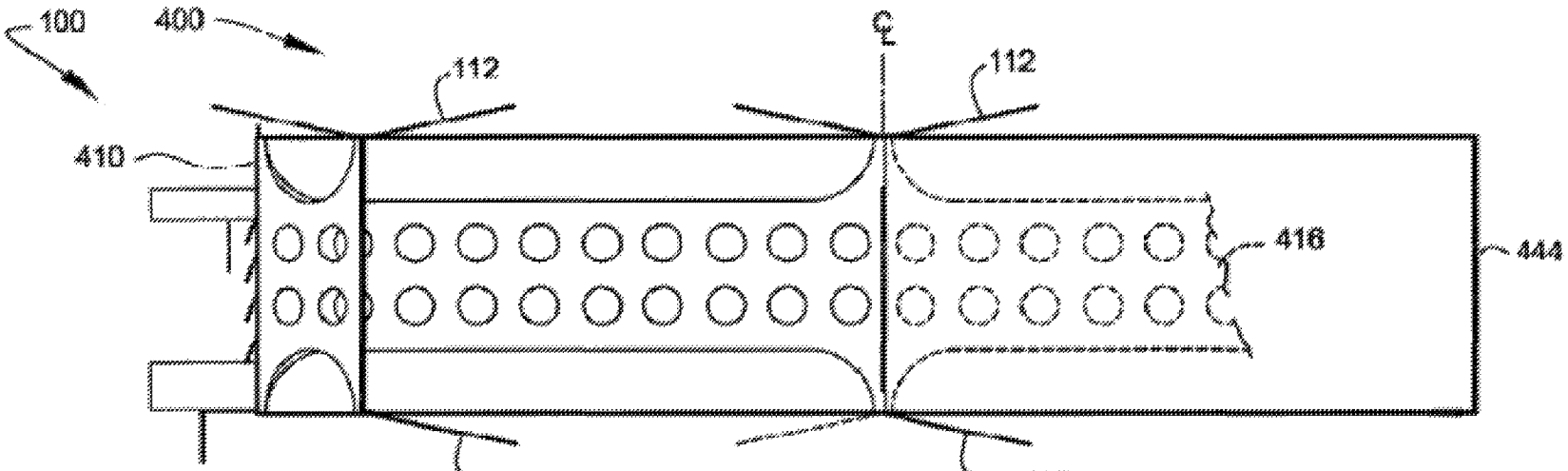
FIG. 15 shows a side view, in partial section, of an alternate container liner according to another embodiment of a container liner system.
Figure 16:
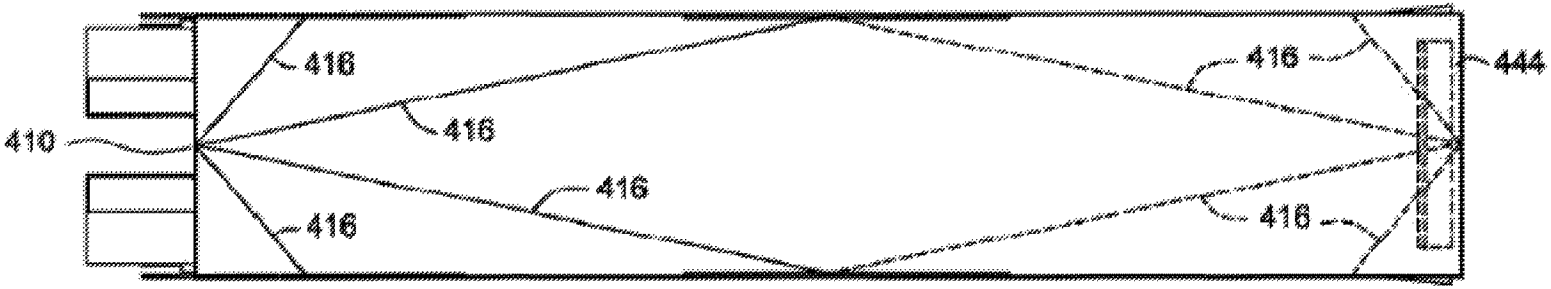
FIG. 16 shows a top view, in partial section, of the alternate container liner of FIG. 15.

In an embodiment, attachment end 152 of each internal baffle 116 is directly joined to rear bulkhead wall 110 along one of two substantially parallel and substantially vertical lines of attachment identified herein as rear attachment line 156 and rear attachment line 158, as shown (at least embodying herein wherein the rear-boundary-wall end comprises at least one rear attacher adapted to attach the rear boundary-wall-end to such at least one substantially vertical rear-boundary-wall). It should be noted that embodiments of container liner system 100 comprise a single line of rear attachment as illustrated in FIG. 15 and FIG. 16. Rear attachment line 156 and rear attachment line 158 are oriented generally perpendicular to lower containment panel 136 and are located anywhere from a third to halfway (for single lines of attachment) across the width of the rear bulkhead wall 110, as shown.

In particular embodiments, container liner 102 comprises at least two internal baffles 116 positioned symmetrically about longitudinal line 160, as shown. In a specific embodiment, container liner 102 comprises at least four internal baffles 116 comprising symmetrical disposed pairs identified herein as internal baffles 116*a* and internal baffles 116*b*, as shown (at least embodying herein wherein the deflection limiter comprises more than two load transfer members each adapted to transfer a direct line of tensional force between the substantially vertical rear-boundary-wall and the substantially vertical forward boundary-wall). Internal baffles 116*a* and internal baffles 116*b* may comprise an arrangement of short and long relative lengths to assist in distributing the load imposed on rear bulkhead wall 110 throughout the forward portions of container liner 102, as shown.

Therein, a first internal baffle 116*a* is joined to rear bulkhead wall 110 at rear attachment line 156 and extends forward at an angle of about 45 degrees relative to rear bulkhead wall 110 to attach to left sidewall 142, as shown (at least embodying herein wherein such at least one forward boundary-wall-end comprises a forward attacher adapted to attach such at least one forward boundary-wall-end to the substantially vertical forward boundary-wall). A second internal baffle 116*a*, which is positioned opposite, may be joined to rear bulkhead wall 110 at rear attachment line 158 and extend forward at an angle of about 45 degrees to attach to right sidewall 140, as shown (at least embodying herein wherein the forward boundary-wall-end comprises a forward attacher adapted to attach the forward boundary-wall-end to the substantially vertical forward-boundary-wall). An internal baffle 116*b* may be joined to rear bulkhead wall 110, also at rear attachment line 156, and extend forward to attach to the left peripheral edge 164 of forward bulkhead 144, as shown (at least embodying herein wherein the forward boundary-wall-end comprises a forward attacher adapted to attach the forward boundary-wall-end to the substantially vertical forward-boundary-wall).

In an embodiment, internal baffle 116*b* extends along a line greater than 45 degrees relative to rear bulkhead wall 110, as shown (at least embodying herein wherein the direct line of tensional force of the load transfer member comprises an angle greater than 45 degrees with respect to a plane comprising the substantially vertical rear boundary wall). This arrangement distributes loads well forward within the liner, as shown. Therein, a second opposing internal baffle 116*b* may be joined to rear bulkhead wall 110 at rear attachment line 158 and extend forward to attach to the right peripheral edge 166 of forward bulkhead 144, as shown (at least embodying herein wherein the forward boundary wall-end comprises a forward attacher adapted to attach the forward boundary-wall-end to the substantially vertical forward-boundary-wall).

The second internal baffle 116*b* may also extend along a line greater than 45 degrees relative to rear bulkhead wall 110 to distribute forces to the forward portions of the liner, as shown (at least embodying herein wherein the load transfer member comprises an angle greater than 45 degrees with respect to the substantially vertical rear boundary-wall). Also, note that internal baffles 116 engage only vertical walls of the liner to avoid the direct application of transmitted loads on lower containment panel 136, thus assisting in maintaining lower containment panel 136 in a flat configuration. Upon reading the teachings of this specification, those of ordinary skill in the art will now understand that, under appropriate circumstances, considering such issues as user preference, intended use, design preference, etc., other anchoring arrangements, such as attaching both internal baffles to opposing sidewalls, etc., may suffice.

Herein, attachment end 152 and attachment end 154 of each baffle may be attached to its respective bulkhead and containment wall along a substantially continuous line of attachment identified herein as baffle seam 170, as shown. Baffle seam 170 is oriented substantially perpendicular to lower containment panel 136 in an embodiment. These substantially continuous lines of attachment each comprise an attachment length substantially equal to interior height B (extending the vertical distance between upper containment panel 134 and lower containment panel 136), as shown. This arrangement of extended length attachments further assists in evenly distributing the loads developed at the bulkheads throughout the structure of container liner 102. The above-described attachment arrangements of internal baffles 116 at least embodying herein wherein the rear attacher comprises a rear attachment-length; the forward attacher comprises a forward attachment length; and the rear attachment length and the forward attachment length are each oriented substantially perpendicular to the substantially horizontal lower-containment-panel.

In an embodiment, each baffle 116 is permanently attached to its respective bulkhead or containment wall, typically by mechanical fastening, and sometimes by sewing. Baffle seam 170 is reinforced by the application of a vertical band of applied webbing identified herein as baffle seam strap 172, as shown. Baffle seam strap 172 may be applied to the exterior face of container liner 102, as shown, and functions to reduce the tendency of internal baffles 116 to tear away from the containment wall under high loads. Upon reading the teachings of this specification, those of ordinary skill in the art will now understand that, under appropriate circumstances, considering such issues as user preference, intended use, etc., other attachment methods, such as chemical bonding, heat bonding, etc., may suffice;

In an embodiment, internal baffles 116 are constructed from a durable material having suitable mechanical properties including appropriate tensile strength. Internal baffles 116 comprise an arrangement of apertures 146 to permit passage of flowable material 108 during loading and discharge. Apertures 146 may be round in shape to reduce stress points within internal baffles 116 underload. Upon reading the teachings of this specification, those of ordinary skill in the art will now understand that, under appropriate circumstances, considering such issues as intended use, nature of cargo, etc., other aperture arrangements, such as, for example, ovals, elongated slots, the use of baffles without apertures, etc., may suffice. The loads transferred by internal baffles 116 may subsequently be transferred out to shipping container 104 by an arrangement of tie-down straps 112, as shown. Tie-down straps 112 are positioned directly over and directly under the centerline 182 of baffle seam 170, as best illustrated in FIG. 7A. In a particular embodiment, tie-down straps 112 are permanently attached to the outer faces of upper containment panel 134 and lower containment panel 136, typically by mechanical fastening with sewing being most preferred.

Figure 7B:
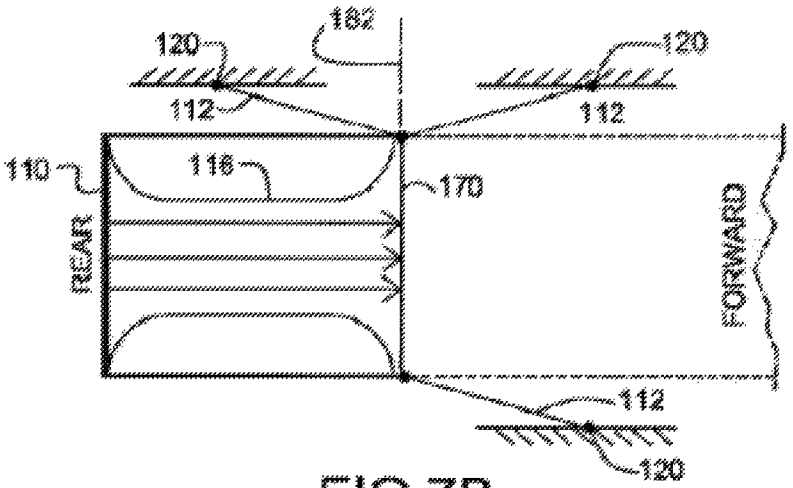
FIG. 7B shows a diagram illustrating the transfer of load forces through the container liner embodiments according to various embodiments of a container liner system.
Figure 7A:
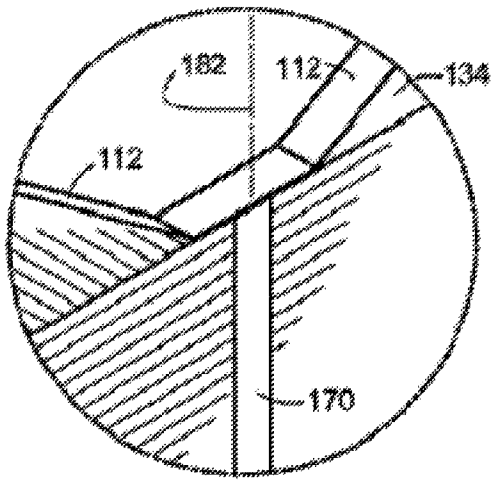
FIG. 7A shows the detailed view 7-7 of FIG. 5A.

FIG. 7B shows a diagram illustrating the transfer of load forces through various embodiments of container liner system 100. Internal baffles 116 may function as force transfer members to transfer loads from rear bulkhead wall 110 to baffle seam 170 of forward containment wall 138, as shown. From baffle seam 170, the load forces are transferred, in a substantially direct manner, to upper and lower tie-down straps 112, as shown. The force loads are then directed to anchor points 120, of shipping container 104, as shown. This arrangement efficiently moves the load forces through the structural elements of the liner, as shown.

Figure 7C:
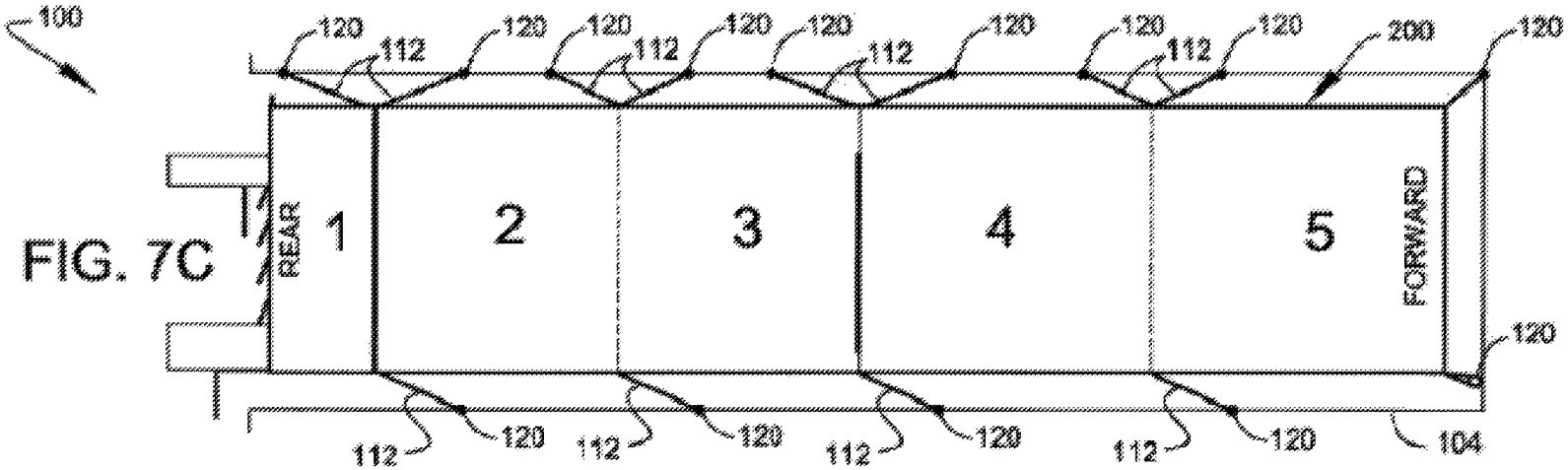
FIG. 7C shows a diagram illustrating the subdividing of loads within the container liner according to various embodiments of a container liner system.

FIG. 7C shows a diagram illustrating the subdividing of loads within container liner embodiments. To assist in illustrating preferred principals of container liner system 100, the diagram of FIG. 7C utilizes an extended liner similar to alternate container liner 200 of FIG. 11A. (Alternate container liner 200 may accommodate the internal configurations of a shipping container 104 comprising a length of about 40 feet).

Referring now to FIG. 7C, with continued reference to FIG. 5A through FIG. 7B, tie-down straps 112 are spaced along the horizontal upper and lower peripheral edges of upper containment panel 134 and lower containment panel 136, respectively, as shown. In an embodiment, tie-down straps 112 distribute the weight evenly along substantially the entire length of container liner 102, so that the weight inside container liner 102 is not dependent on a small number of hooks and bars securing the liner to the front end of the container, and a few bars securing the liner at the rear end of the container. Thus, the load of the liner is subdivided into a plurality of supported regions, as shown.

Although the entire liner envelope contributes, in small part, to the overall support of flowable material 108, a substantial portion of each supported region may be structurally supported substantially independently of all other regions, as shown. In generalized terms, the front anchors are substantially responsible for the weight of the product from the forward anchor points to about the first set of tie-down straps (generally defined as region 5). The first tie-downs are substantially responsible for the weight of the product between their placement and the next set of tie-downs (generally defined as region 5), and so on until, at the rear of the container, all the weight has been supported (at least embodying herein the external load-transfer-member comprises a load divider adapted to assist in dividing the transfer of the load between a plurality of supports within the cargo container and further embodies herein a first strap-end and a second strap end). Upon reading the teachings of this specification, those of ordinary skill in the art will now understand that, under appropriate circumstances, considering such issues as intended use, cargo weight, etc., other anchor strap arrangements, such as, for example, using additional sets of structural tie-down straps as necessary for additional strength, etc., may suffice.

In an embodiment, to further assist in distributing loads, each upper tie-down strap 112 comprises two distal ends 113 identified herein as rear-projecting strap end 174 and forward-projecting strap end 176, as shown (at least embodying herein the external load-transfer member comprises a load divider adapted to assist in dividing the transfer of the load between a plurality of supports within the cargo container and further embodies herein a first strap-end and a second strap-end). Rear projecting strap end 174 and forward-projecting strap end 176 may each project outwardly from a common attachment point located at the outer face of upper containment panel 134, as best shown in FIG. 7A. Each lower tic-down strap 112 adjacent lower containment panel 136 may comprise a single forward projecting strap end 176; however, two-way strap embodiments matching the upper tie-down straps 112 may be utilized in heavy cargo applications.

FIG. 6 shows the detailed view 6-6 of FIG. 5A illustrating the strap-tensioning buckles 168 of lie-down straps 112. Buckles 168 allow the installer to selectively tension the tie-down straps 112 thus controlling the manner in which container liner 102 is anchored within shipping container 104, as further described below. Buckles 168 may comprise any commercially available webbing hardware with cam-type locking operations.

Upon reading the teachings of this specification, those of ordinary skill in the art will now understand that the unique structures and arrangements of tie-down straps 112 may serve at least three principal functions: they distribute the product weight equally between the individual tie-down straps, located at varying distances on both the top and bottom sides along the length of container liner 102; they eliminate the wrinkles and "fold-over's," that slow down the discharge process; and they enhance safety during the filling, shipping, and discharge process.

Figure 9:
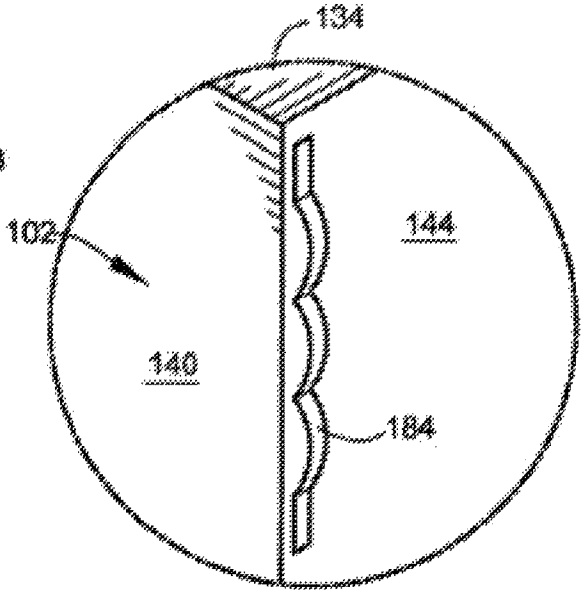
FIG. 9 shows the detailed view 9-9 of FIG. 5A.

Refer now to the forward containment walls 138, specifically to the attachment arrangements adjacent forward bulkhead 144, and specifically to the detailed view 9-9 of FIG. 5A and the detailed view 10-10 of FIG. 5A. As best shown in FIG. 9, the upper corners of forward bulkhead 144 comprise front support strap 184. Front support straps 184 may comprise a length of webbing forming three or more loop. In an embodiment, each front support strap 184 is permanently attached, typically sewn, to the external face of forward bulkhead 144. Front support straps 184 may function as upper support points in the anchoring of container liner 102 within shipping container 104. Loops formed in front support strap 184 may be adapted to directly engage forward anchor points 120 of shipping container 104 or, indirectly engage forward anchor points 120 using an appropriate anchor device.

Figure 10:
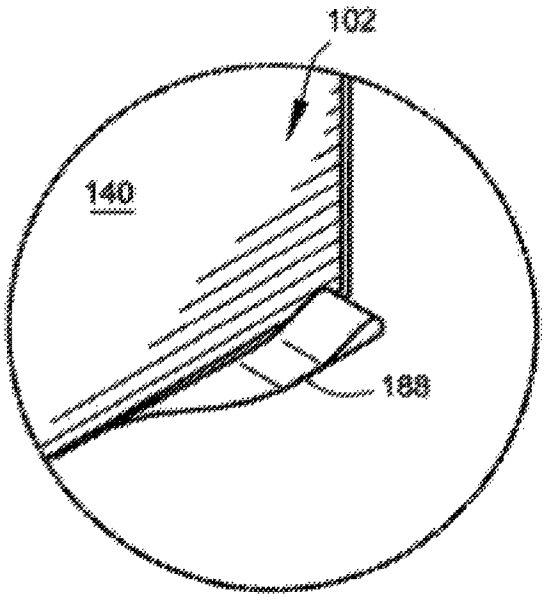
FIG. 10 shows the detailed view 10-10 of FIG. 5A.

In an embodiment, container liner 102 is adapted to utilize a single forward anchor bar as a mechanism for securing container liner 102 within shipping container 104 when shipping heavy flowable materials 108. Herein, lower containment panel 136 comprises a bar sleeve 186, as shown. Also, bar sleeve 186 may be permanently attached, typically sewn, to the underside of lower containment panel 136. Bay sleeve 186 may further comprise a flattened tubular structure adapted to receive a steel anchor bar of the type conventionally used in the anchorage of container liners. Each forward corner of lower containment panel 136 may comprise a bar strap 188, as illustrated in FIG. 10. Each bar strap 188 may be similarly adapted to receive one end of the above-described steel anchor bar. Furthermore, each bar strap 188 may be permanently coupled, preferably sewn, within the seam joining lower containment panel 136 and the adjacent sidewalls, as shown. Together, bar sleeve 186 and bar straps 188 provide a mechanism for securing the front of container liner 102 using a single front-mounted steel anchor bar (at least embodying herein wherein the separating enclosure further comprises a restraint-bar supporter adapted to assist in supporting at least one restraint bar in a position assisting restraint of the substantially flexible material against movement).

Container liner 102 is constructed from a substantially flexible and durable material in various embodiments, such as but not limited to woven polypropylene (PP) or woven polyethylene (PE) material. The weight and strength of the preferred fabric is selected based on anticipated cargo load with rear bulkhead wall 110, right sidewall 140, and left sidewall 142 generally comprising a heavier material than the upper, lower, and forward bulkhead panels. Embodiments of container liner 102 may be laminated with a sheet of polyethylene or other plastic material as an added membrane adapted to limit the transmission of moisture through the containment boundary.

A woven polypropylene material suitable for use in the construction of upper containment panel 134, lower containment panel 136, and forward bulkhead 144 may comprise a 35 material weight of about 95 grams (gm) per square meter. A woven polypropylene material suitable for use in the construction of rear bulkhead wall 110, right sidewall 140, and left sidewall 142 may comprise a material weight of about 220 gm per square meter. It should be noted that rear bulkhead wall 110 may comprise an additional interior lamination of lightweight woven sheet material to provide additional structural reinforcement to the rear containment boundary. For example, embodiments of rear bulkhead wall 110 comprise an outer layer of woven polypropylene material comprises a material weight of about 220 gm per square meter assembled adjacent an inner layer of woven polypropylene material comprises a material weight of about 95 gm per square meter. Upon reading the teachings of this specification, those of ordinary skill in the art will now understand that, under appropriate circumstances, considering such issues as intended use, nature of cargo, etc., other panel arrangements, such as, for example, constructing the rear bulkhead and side walls as a single continuous panel, etc., may suffice.

In an embodiment, internal baffles 116 are constructed from a durable material having suitable mechanical properties including appropriate tensile strength. Sometimes, for economy of construction, the material of internal baffles 116 comprises substantially the same flexible material used for the enveloping walls and bulkheads. A woven polypropylene material suitable for use in the construction of internal baffles 116 may comprise a material weight of about 95 gm per square meter. Typically, the material of upper fill chutes 124 and discharge chutes 114 are constructed from a similar woven polypropylene material comprising a material weight of about 95 gm per square meter. All strapping and webbing may comprise a heavy structural composition comprising woven flat webbing, such as but not limited to nylon webbing having a minimum width of about 25 millimeters (mm).

The unique structures and arrangements of container liner 102 require the installer to follow a specific sequence of steps when installing container liner 102 within shipping container 104. In the following description, it is helpful to again referred to FIG. 1, as well as the teachings of the remaining figures. In an initial preferred installations step, a folded container liner 102 is placed on the interior floor of shipping container 104 adjacent rear opening 107. The container liner 102 may be packaged to unfold as the installer pulls container liner 102 toward the front of shipping container 104. The installer next secures container liner 102 to the front of shipping container 104 by placing a steel bar through the right and left bar straps 188 and bar sleeve 186, prior to securing the steel bar to the forward end of shipping container 104. In a subsequent preferred step, the installer engages fastening devices, such as a snap hook, within one of the three loops of both the right and left front support straps 184. Next, preferably using the snap hooks, the installer secures the upper portion of container liner 102 to anchor points 120 located at the upper front corners of shipping container 104.

The installer has now completed the securing of the front portion of container liner 102 to shipping container 104 and now has at least two methods with which to complete the installation. In a first method, after securing the front of the liner to the front of the container, the upper and lower tie-down straps 112 located on each side of container liner 102 are secured to shipping container 104. Beginning with the forward-most tie-down straps 112, each tie-down strap 112 may be coupled (using an appropriate fastening device) to an adjacent anchor point 120 located along the top and bottom sides of shipping container 104 (typically nearest the rear of the forward-most tie-down straps 112). In this act, the rear-projecting strap ends 174 of the most forward tie-down straps 112 are coupled to the closest available anchor points 120 on the sides of the container (generally toward the rear of the container). Then, the installer draws each rear-projecting tie-down strap 174 through its respective buckle 168, until container liner 102 has been drawn tight between the front anchor points and the anchor point 120 on which the now tension rear-projecting tie-down strap 174 is connected. Next, forward-projecting strap end 176 of the same tie-down strap 112 is coupled to an adjacent forward anchor point 120 and is drawn tight. This process is repeated with each tie-down strap 112, starting with the upper or the lower tie-downs, typically progressing front to back.

Once both the rear and the forward portions of tie down strap 112 have been attached and pulled tight, container liner 102 has achieved a condition of proportional weight distribution. In this condition, the weight of flowable material 108 is distributed between many sets of tie-down straps 112 connection points.

A second method of securing tie-down straps 112 to produce equal weight distribution is to hook the loops located in the back corners of container liner 102 to an accessory buckle and strap system that preferably hooks onto the back of the container. When these accessory straps have been pulled tight, container liner 102 tightens from front to rear eliminating the need to draw the rear-projecting strap ends 174 of tie-down straps 112 tight before tightening the forward-projecting strap ends 176 along the upper and lower sides of the liner. After the forward-projecting strap ends 176 are tightened, the accessory buckle and strap system originally used to tighten container liner 102 from front to rear can, if desired, be removed.

As previously described, attachment end 152 of each internal baffle 116 is directly joined to rear bulkhead wall 110, preferably along one of two substantially parallel and substantially vertical lines of attachment identified herein as rear attachment line 156 and rear attachment line 158, as shown. Despite the effective use of baffles to restrain rear bulkhead wall 110 against outward deflection, rear bulkhead wall 110 still exhibits some outward bulging (in the space between the sides of the liner and the generally vertical line where internal baffle 116 is sewn to rear bulkhead wall 110). To prevent the outward deflection from extending to rear opening 107 and interfering with the operation of swinging doors 109, container liner 102 may be constructed to comprise an overall liner length somewhat shorter than the length of the interior of container shipping container 104. Generally, this "hold-back" distance is preferably equivalent to about 5% of the overall linear length of the liner.

In an embodiment, specific hold-back distances are determined through physical field testing and measurement. Alternately, the hold-back distance may be calculated by modeling the system to determine (through structural calculation) the degree to which the rear bulkhead wall deflects under the surcharge of the contained flowable material. For example, the deflection of the rear wall of container liner 102 under load may be calculated by estimating the loading of flowable material 108 applied across the rear wall of container liner 102. In general, this calculation assumes the greatest loading to occur as the liner is tilted during unloading (although live loads and similar dynamic loading conditions may also be considered if atypical shipping conditions are predicted). Next, the physical size (maximum spans) of the rear bulkhead wall, baffles, and forward support walls are considered along with the mechanical properties of the materials used in their construction (elastic creep, tensile strength, etc.). If the selected tie-down straps exhibit a high degree of elasticity, or comprise longer lengths than those of the described embodiments, their contributions may also be included in the calculation. When taken together, those skilled in the art may generate suitably accurate predictors of deformation, thus allowing the container liner 102 to be pre-adjusted for length.

Figure 11A:
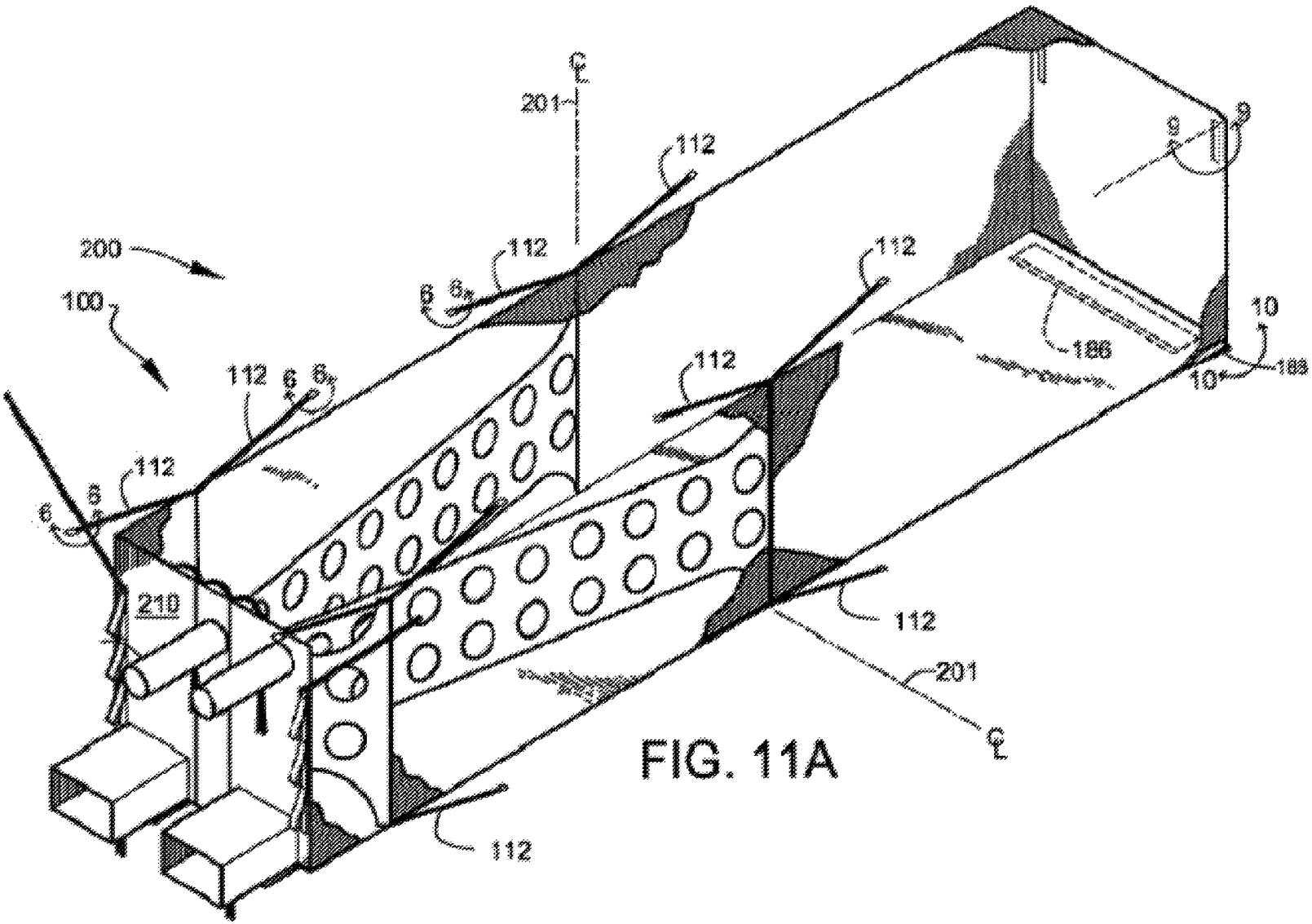
FIG. 11A shows a perspective view, in partial section, of another design of container liner according to another embodiment of a container liner system.
Figure 11B:
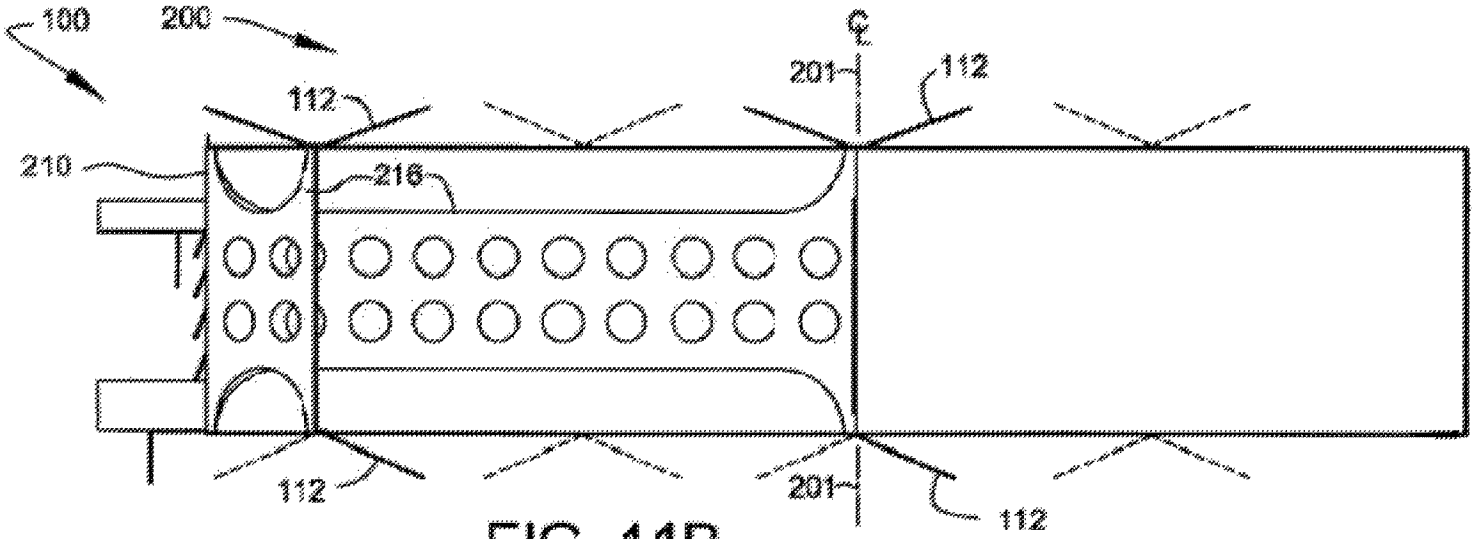
FIG. 11B shows aside view, in partial section, of the container liner of FIG. 11.
Figure 12:
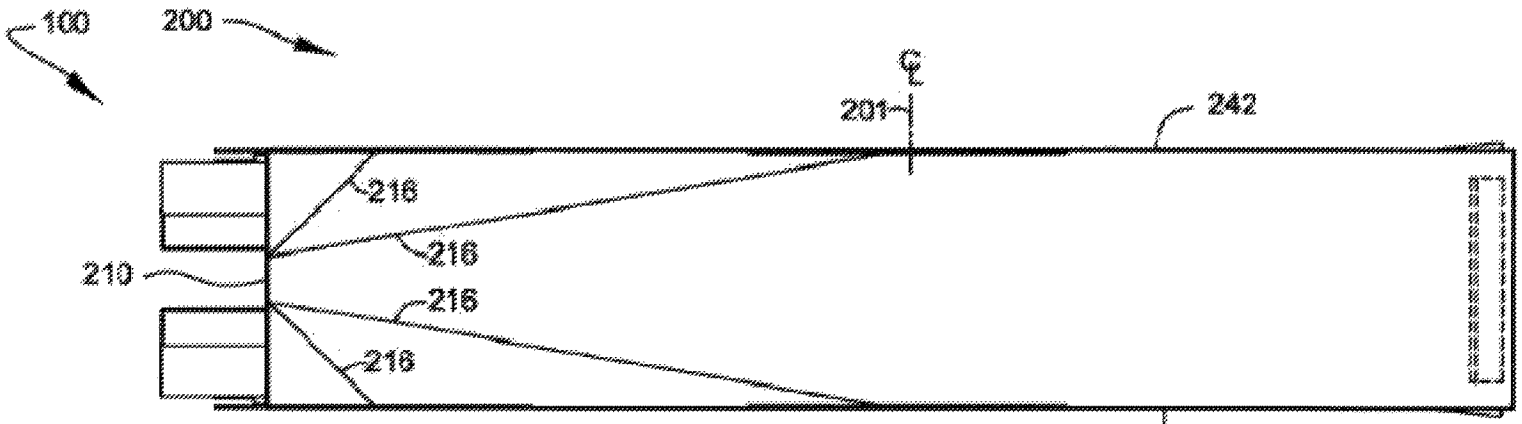
FIG. 12 shows a top view, in partial section, of the container liner of FIG. 11.

FIG. 11A shows a perspective view, in partial section, of alternate container liner 200, of container liner system 100, according to an embodiment of the present invention. FIG. 11B shows a side view, in partial section, of alternate container liner 200 of container liner system 100, and of alternate container liner 200 of FIG. 12A. FIG. 12 shows a top view, in partial section, of alternate container liner 200 of FIG. 11A. It should be noted that in the depiction of FIG. 11A and FIG. 11B the right sidewall and upper panel have been deleted from the view to more clearly depict the preferred interior arrangements of alternate container liner 200. Similarly, in the depiction of FIG. 12 the upper panel has been deleted from the view to further assist in depicting the preferred interior arrangements. Alternate container liner 200 may comprise a liner of extended length, accommodating the internal configurations of a shipping container 104 comprising a length of about 40 feet. The structures and arrangements of alternate container liner 200 may be substantially similar to those of container liner 102. Normally, internal baffles 216 of alternate container liner 200 extend forward from rear bulkhead 210 to intersect the approximate midline 201 of right sidewall 240 and left sidewall 242, as shown. The dashed line depiction of FIG. 11 illustrates the optional placement of additional tie-down straps 112 used when additional distribution of cargo loads is required.

Figure 13:
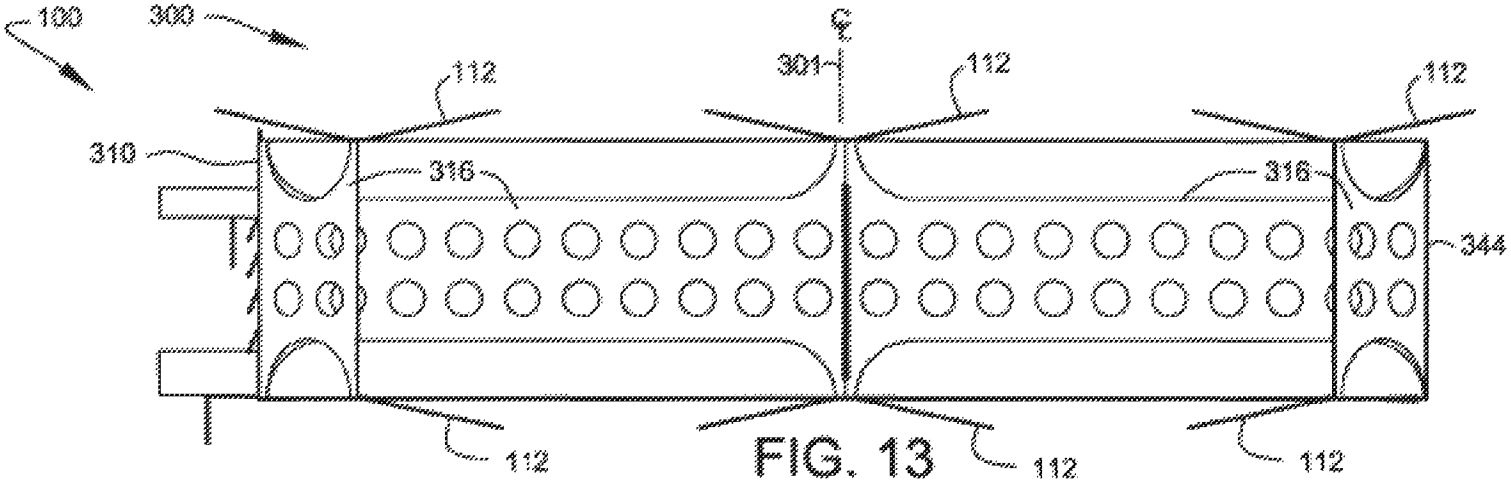
FIG. 13 shows a side view, in partial section, of an alternate container liner according to another embodiment of a container liner system.
Figure 14:
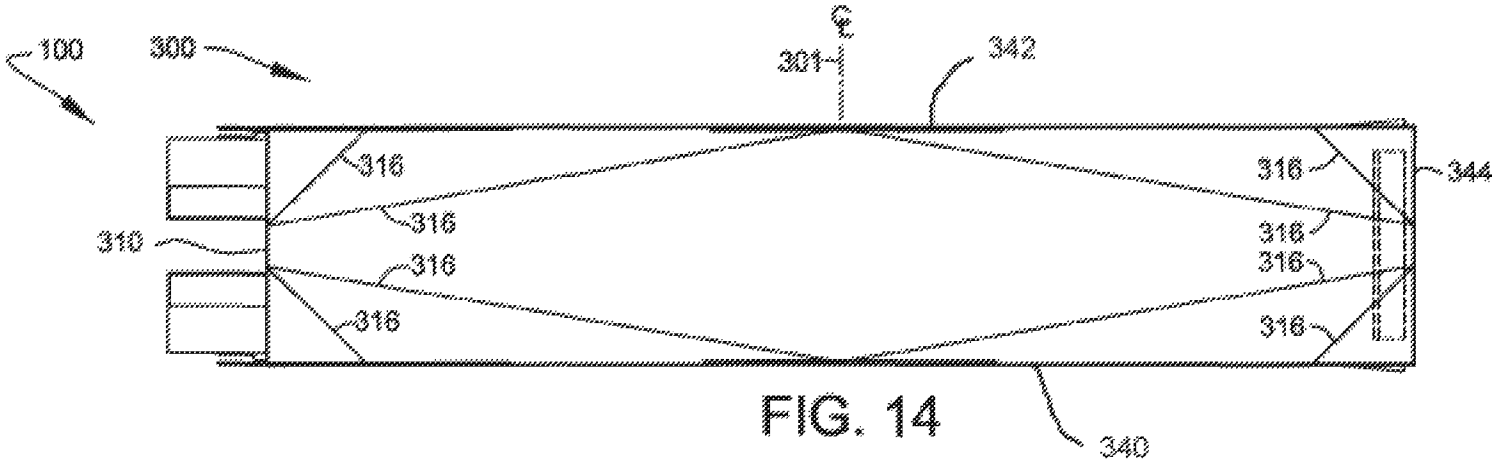
FIG. 14 shows atop view, in partial section, of the alternate container liner of FIG. 13.

FIG. 13 shows aside view, in partial section, of alternate container liner 300, of container liner system 100, according to another embodiment of the present invention. FIG. 14 shows a top view, in partial section, of alternate container liner of FIG. 13. It is again noted that in the depiction of FIG. 13 the right sidewall has been deleted from the view to further assist in 40 depicting the interior arrangements of alternate container liner 300. Similarly, in the depiction of FIG. 14 the upper panel has been deleted from the view to further assist in depleting the interior arrangements, In an embodiment, alternate container liner 300 comprises a liner length accommodating the internal configurations of a shipping container 104 having a length of about 40 feet. For added strength, the baffle configuration of the prior embodiments has been repeated at the front of the liner. Alternate container liner 300 may comprise a double set of internal baffles 316 that comprises a first set, extending forward from fear bulkhead 310, and an opposing set extending rearward from forward bulkhead 344. In an embodiment, the deflection limiter further comprises at least one load-transfer member adapted to transfer a direct line of tensional force between such a first sidewall and the substantially vertical front-boundary-wall, and at least one load-transfer-member adapted to transfer least one direct line of tensional force between the second sidewall and the substantially vertical rear boundary-wall). In a particular embodiment, both sets intersect the approximate midline 301 of right sidewall 340 and left sidewall 342, as shown. A part from the unique baffle arrangements, the structures arid configurations of alternate container liner 300 are substantially similar to those described for container liner 102.

FIG. 15 shows a side view, in partial section, of alternate container liner 400 according to another preferred embodiment of the present invention. FIG. 16 shows a top view, in partial section, of alternate container liner 400 of FIG. 15. The upper and sidewalls have again been deleted from the view for clarity. In the embodiments of FIG. 15 and FIG. 16, baffles 416 are coupled to rear bulkhead wall 410 along a single vertical line, as shown. In other embodiments, opposing arrangements of baffles are included, for added strength at forward bulkhead 444, as indicated by the dashed line depiction of FIG. 16.

Figure 27:
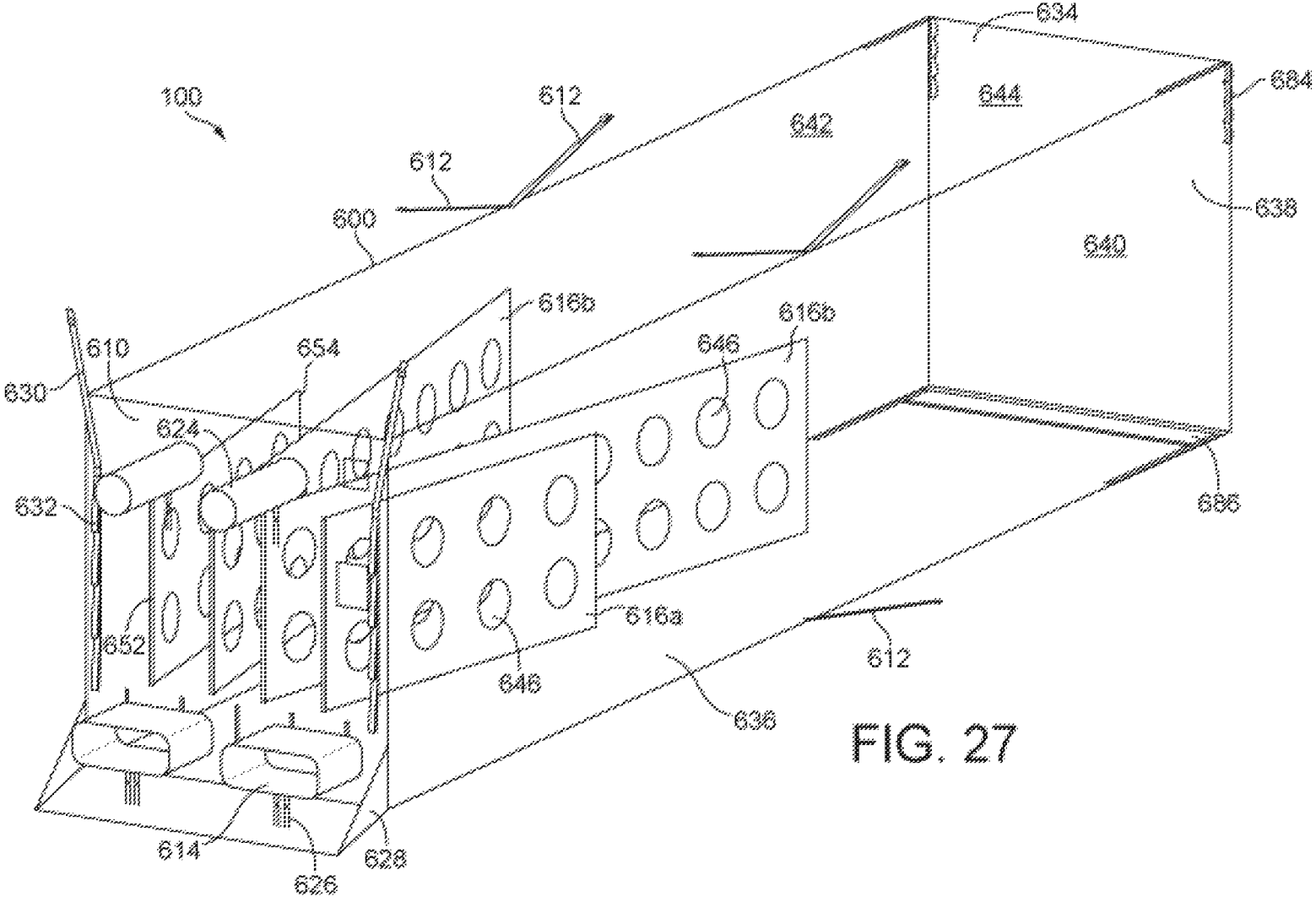
FIG. 27 shows a perspective, transparent view of another embodiment of a container liner system.

FIGS. 27-30 show various views of yet another embodiment of a container liner system. Any dimensions shown in conjunction with FIGS. 27-30 is for exemplary purpose only, and not as a limitation. FIG. 27 shows a transparent perspective view of an embodiment of an alternate container liner 600 as part of container liner system 100 for installation within shipping container 104 according to a preferred embodiment of the present invention. Container liner 600 is similar to container liners 102, 200, 300, and 400, described previously, and includes a rear bulkhead wall 610, an upper containment panel 634, a lower containment panel 636, and a forward containment wall 638 comprising right sidewall 640, left sidewall 642, and forward bulkhead 644, similar to elements 110, 134, 136, 138, 140, 142, and 144, respectively. Container liner 600 further comprises tie-down straps 612, similar to tie-down straps 112, which embody external load-transfer-members adapted to transfer a load between the separating enclosure or container liner 600 and the cargo or shipping container 104. Rear bulkhead wall 610 can comprise one or more lower discharge chutes 614, internal baffles 616, upper fill chutes 624, chute ties 626 and port covers 628, similar to elements 114, 116, 124, 126, and 128 described above. Looped bar straps 630 including bar support loops 632, similar to looped bar straps 130 including bar support loops 132, are coupled to rear bulkhead wall 610. Looped bar straps 630 are discussed in greater detail below with respect to FIG. 39.

FIG. 27 further shows baffles 616 disposed within container liner 600 and placed at particular angles within the container liner. In an embodiment, internal baffles 616 are constructed from a durable material having suitable mechanical properties including appropriate tensile strength. Sometimes, for economy of construction, the material of internal baffles 616 comprises substantially the same flexible material used for the enveloping walls and bulkheads. A woven polypropylene material suitable for use in the construction of internal baffles 616 may comprise a material weight of about 95 gm per square meter. Typically, the material of upper fill chutes 624 and discharge chutes 614 are constructed from a similar woven polypropylene material comprising a material weight of about 95 gm per square meter. All strapping and webbing may comprise a heavy structural composition comprising woven flat webbing, such as but not limited to nylon webbing having a minimum width of about 25 mm.

In contrast to the previously described embodiments including alternate container liners 200, 300, and 400, none of the four baffles 616 in container liner 600 originate from the same or similar points or planes on rear bulkhead wall 610 of the container liner. The four separate baffles 616 on rear bulkhead 610 of container liner 600 may assist in distributing the weight of flowable material 108 more evenly than in the embodiments discussed above. By spreading the four baffles to four different places on the back face of the liner with substantially equal spacing, a majority of the bulging of the back face may be eliminated. Spacing of baffles 616 along rear bulkhead 610 is discussed below in greater detail with respect to FIG. 28, and the reduced bulging of rear bulkhead 610 is discussed in greater detail with respect to FIGS. 32A-32D. Configuring baffles 616 to limit or minimize bulging of rear bulkhead 610 allows container liner 600 to be longer than container liners 102, 200, 300, and 400, thereby allowing more product to be loaded into the liner and more efficiently utilize the space available within shipping container 104. In a particular embodiment, baffles 616 comprise two outer or shorter baffles 616*a*, and two inner or longer baffles 616*b*. Other embodiments may comprise additional baffles each coupled to rear bulkhead wall 610 at different points or planes, such as but not limited to, a center baffle or additional baffles between the shorter and longer baffles.

Figure 28B:
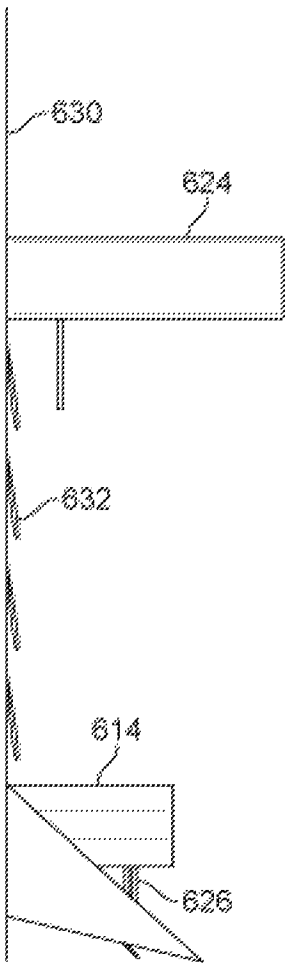
FIGS. 28A-28B show a front view and a partial side view of another embodiment of a container liner system.
Figure 28A:
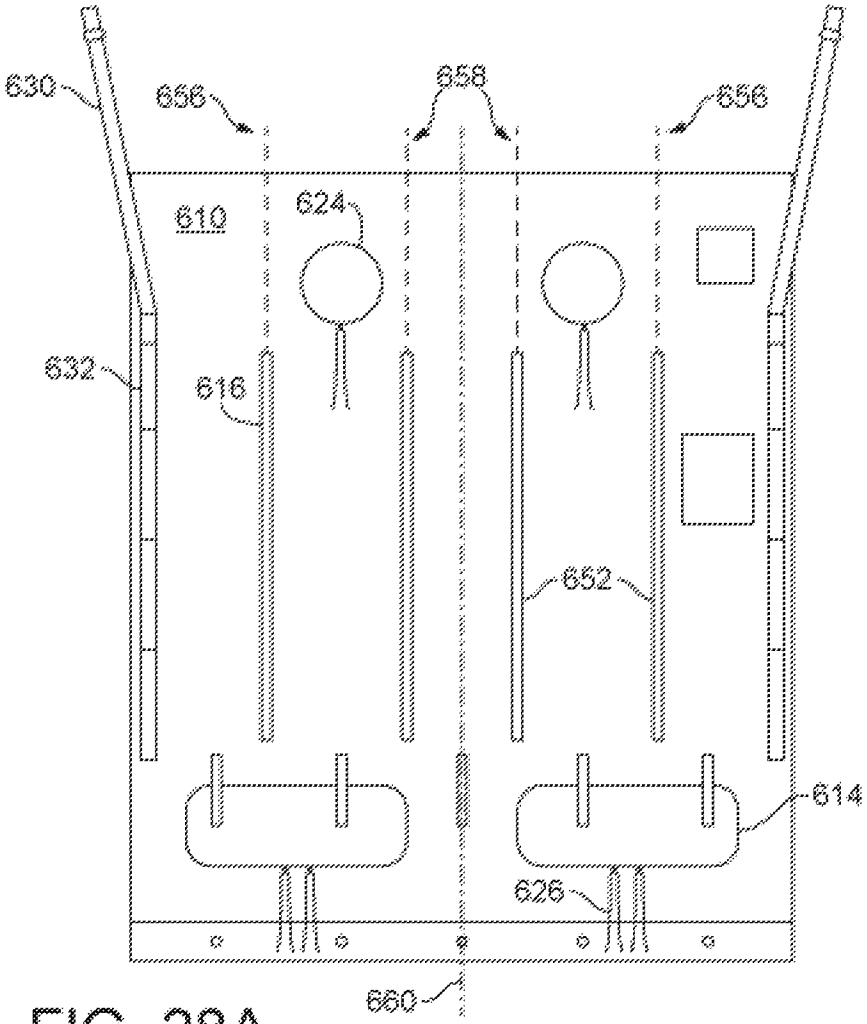

FIGS. 28A and 28B show additional detail of rear bulkhead wall 610 and an exemplary alignment of baffles 616 from the embodiment of container liner 600 shown in FIG. 27. More specifically, FIG. 28A illustrates baffles 616 may be symmetrically placed within container liner 600 along a central axis 660 of rear bulkhead wall 610. Rear attachment ends 652 of baffles 616 can be aligned along substantially continuous lines of attachment that are oriented substantially perpendicular to lower containment panel 636. In an embodiment, baffles 616*a* are aligned with rear attachment lines 656 and baffles 616*b* are aligned with rear attachment lines 658. In an embodiment, each baffle 616 is permanently attached to its respective bulkhead or containment wall, typically by mechanical fastening, and sometimes by sewing. An attachment area for baffles 616 can be reinforced by the application of a vertical band of applied webbing such as baffle seam strap, discussed above. The baffle seam strap can be applied to an exterior face of container liner 600, and function to reduce the tendency of internal baffles 616 to tear away from container liner 600 under high loads. Upon reading the teachings of this specification, those of ordinary skill in the art will now understand that, under appropriate circumstances, considering such issues as user preference, intended use, etc., other attachment methods, such as chemical bonding, heat bonding, or other suitable method may suffice.

FIG. 28A shows baffles 616 are not necessarily coupled along a substantially entire vertical distance between upper containment panel 634 and lower containment panel 636, thereby differing from the arrangement of the rear bulkhead walls shown with respect to container liners 200, 300, and 400. Instead, baffles 616 can be offset from upper containment panel 634 and lower containment panel 636 at rear bulkhead wall 610. By way of example and not limitation, in an embodiment baffles 616 are offset a distance of approximately 0.65 m from upper containment panel 634 and a distance of approximately 0.60 m from lower containment panel 636. By reducing a length that baffles 616 extend along rear attachment lines 656 and 658, a quantity of material required by the baffles is reduced, thereby saving material and cost. Furthermore, outer baffles 616*a* can be spaced approximately 0.5 m from opposing right and left side walls 640 and 642. A distance between outer baffles 616*a* and inner baffles 616*b* can be approximately 0.5 m and a distance between inner baffles 616*b* can be approximately 0.4 m. In other embodiments, however, the baffles 616 may comprise any spacing and alignment on rear bulkhead wall 610.

FIG. 28B shows a cross-sectional view of rear bulkhead wall 610 taken transverse to the view of the rear bulkhead wall shown in FIG. 28A. FIG. 28B shows bar support loops 632 of looped bar straps 630. In an embodiment, bar loops extend a distance of approximately 0.3 meters from bar strap 630. FIG. 28B also shows upper fill chutes 624 and lower discharge chutes 614 extending from rear bulkhead wall 610. In an embodiment, upper fill chutes 624 may extend from rear bulkhead wall 610 a length of approximately 1 m and discharge chutes 614 may extend from rear bulkhead wall 610 a length of approximately 0.6 m.

Figure 29:
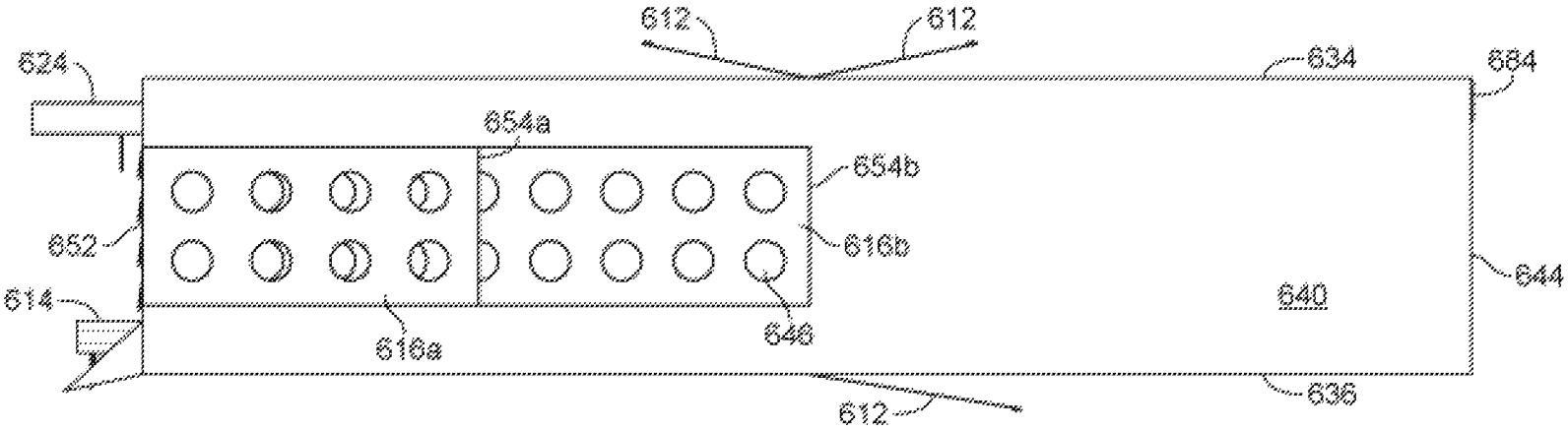
FIG. 29 shows a side view of another embodiment of a container liner system.

FIG. 29 illustrates a transparent side view of the embodiment illustrated in FIG. 27. Because outer baffles 616*a* and inner baffles 616*b* mirror each other across central axis 660, only one inner and one outer baffle are shown in FIG. 29. In other embodiments, however, baffles 616 may comprise various other lengths or dimensions. However, FIG. 29 shows an embodiment in which baffles 616 optionally comprise a substantially similar height of approximately 1.4 m and are disposed at a substantially similar height or plane offset from upper or lower containment panel 634 or 636. In other embodiments, however, baffles 616 may comprise at least two different heights, and/or be placed on the rear bulkhead wall at differing heights. For example, at least one baffle 616 can be disposed a first height or offset from upper or lower containment panel 634 or 636 and another at least one baffle 616 can be disposed a second height or offset from upper or lower containment panel 634 or 636.

As illustrated in FIG. 29, outer baffle 616*a* is shown with rear attachment end 652 coupled to rear bulkhead wall 610 and forward attachment ends 654*a* of baffles 616*a* coupled to right sidewall 640 and left sidewall 642. In an embodiment, forward attachment ends 654*a* can be coupled to sidewalls 640 and 642 at a distance in a range of approximately 2.5-3.5 m from rear bulkhead wall 610, and more preferably a distance of approximately 2.95 m. Similarly, forward attachment ends 654*b* of baffles 616*b* can be coupled to sidewalls 640 and 642 at a distance in a range of approximately 5.5-6.5 m from rear bulkhead wall 610, and more preferably a distance of approximately 5.9 m.

Figure 30:
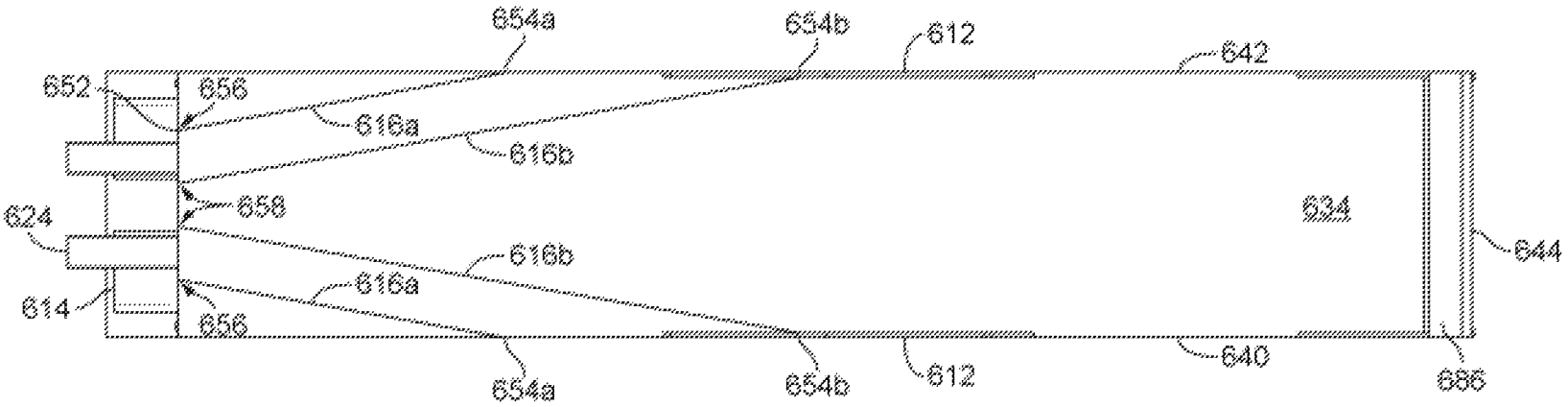
FIG. 30 shows a partial sectioned top view of another embodiment of a container line system.

FIG. 30 illustrates a partially sectioned top view of container liner 600 previously shown in FIGS. 27-29. As shown in FIG. 30, baffles 616 extend from four different points on rear bulkhead wall 610. In the embodiment pictured in FIG. 30, two shorter outer baffles 616*a* comprise rear attachment ends 652 coupled to different points on rear bulkhead wall 610, such as rear attachment lines 656, and extend to points on opposing right and left sidewalls 640 and 642. Outer baffles 616*a* can be coupled with forward attachment ends 654*a* to opposing right and left sidewalls 640 and 642 at a distance approximately one quarter of the distance from the rear bulkhead wall 610 to the forward bulkhead wall 644. In embodiments comprising a container liner 600 comprising a length of approximately 11.8 meters, attachment ends 654*a* of baffles 616*a* are coupled to opposing right and left sidewalls 640 and 642 at a distance of in a range of approximately 2.5-3.5 m from rear bulkhead wall 610, and more preferably a distance of approximately 2.95 m. Each of inner baffles 616*b* likewise extend from different points on the rear bulkhead wall, such as rear attachment lines 658, to points on opposing side walls, and extend to points on opposing right and left sidewalls 640 and 642. Inner baffles 616*b* can be coupled with forward attachment ends 654*b* to opposing right and left sidewalls 640 and 642 at a distance approximately one half of the distance from the rear bulkhead wall 610 to the forward bulkhead wall 644. In embodiments comprising a container liner 600 comprising a length of approximately 11.8 meters, attachment ends 654*b* of baffles 616*b* are coupled to opposing right and left sidewalls 640 and 642 at a distance of in a range of approximately 5.5-6.5 m from rear bulkhead wall 610, and more preferably a distance of approximately 5.9 m. In other embodiments, baffles 616, including outer baffles 616*a* and inner baffles 616*b*, may extend from any points on rear bulkhead wall 610 to any points on opposing right and left sidewalls 640 and 642. Advantageously, attachment ends 654 of baffles 616 are coupled to opposing right and left sidewalls 640 and 642 to align with tie-down straps 112 to provide for better load transfer.

Figure 31A:
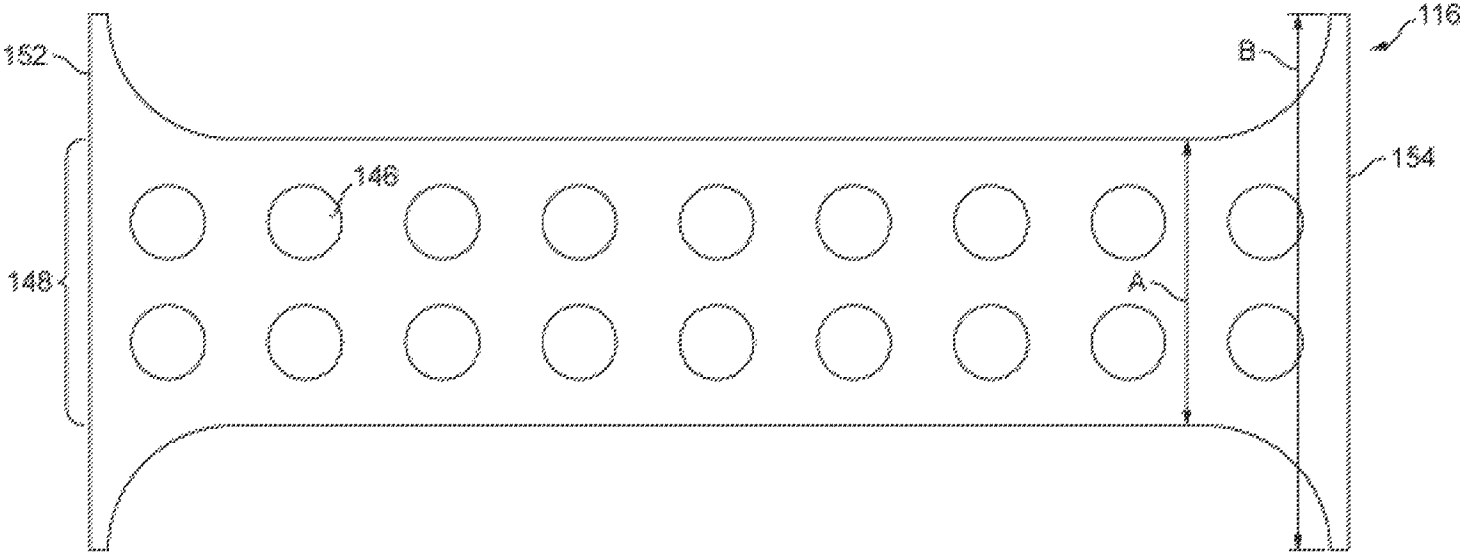
FIGS. 31A-31B show side views comparing baffle embodiments.
Figure 31B:
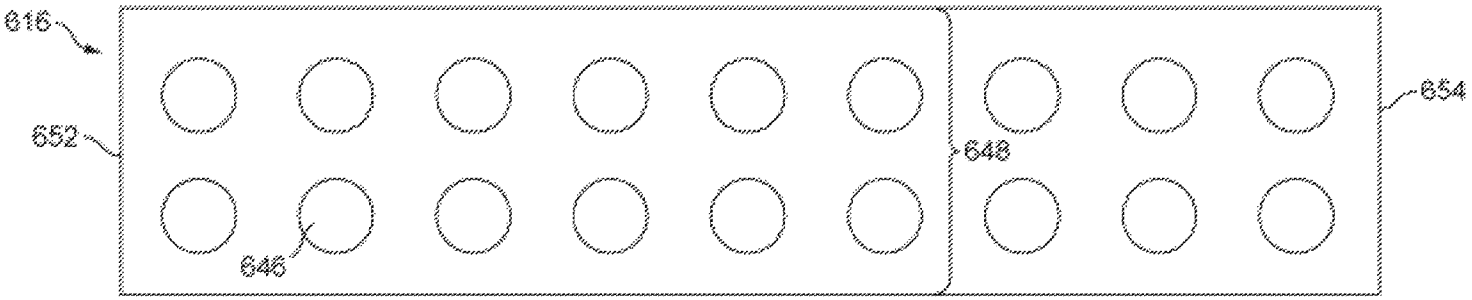

FIGS. 31A-31B illustrate a comparison between a design of baffles 116, shown in FIG. 31A, and baffles 616, shown in FIG. 31B. As shown in FIG. 31A, baffles 116 comprise mid portion 148 including a substantially uniform vertical width A, which in an embodiment can be a width of about 1.2-1.4 m, and more preferably about 1.3 m. Attachment ends 152 and 154 of internal baffle 116 terminate by sweeping away from mid portion 148 along opposing arcs. Attachment ends 152 and 154 are wider than mid portion 148, and may comprise a vertical width B substantially equal to a distance that extends between upper containment panel 134 and lower containment panel 136, such as approximately 2.4-2.8 m and more preferably about 2.6 m. Mid-portion 148 may comprise a vertical width A equal to about one half the vertical width B.

As shown in FIG. 31B, baffle 616 differs from baffle 116 by removal or elimination of sweeping arcs to create attachment ends 652 and 654 comprising vertical widths substantially equal to a vertical width of mid portion 648. In an embodiment, vertical width of mid portion 648 can be in a range of approximately 1.2-1.4 m and more preferably about 1.3 m. Additionally, baffle 616 can include a horizontal length of approximately 6 m, and preferably about 5.984 m. By eliminating flared attachment ends 152 and 154, outer edges of attachment ends 652 and 654 do not function as top to bottom guides for the sewing of container liner 600. However, baffles 616 use approximately half of the material used by baffles 116 and further eliminate the labor necessary to cut out openings in baffles 116 to form flared attachment ends 152 and 154. In an embodiment, baffle 116 uses approximately 82 square meters of material while baffle 616 requires approximately 41 square meters of material. Accordingly, the decreases in material and in labor needed for the formation and utilization of baffle 616, while still providing a desired function of load transfer to reduce or minimize bulging of rear bulkhead wall 110, makes baffle 616 a more cost effective and efficient than baffle 116 for some applications.

Figure 32A:
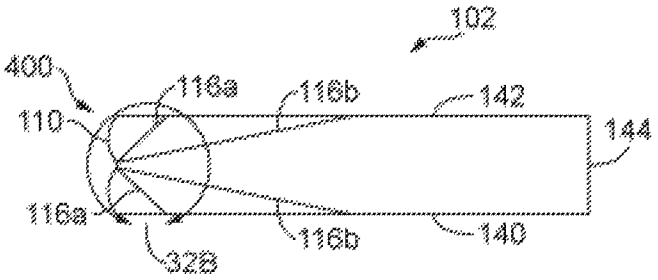
FIGS. 32A-32D shows a sectioned top views comparing embodiments.
Figure 32B:
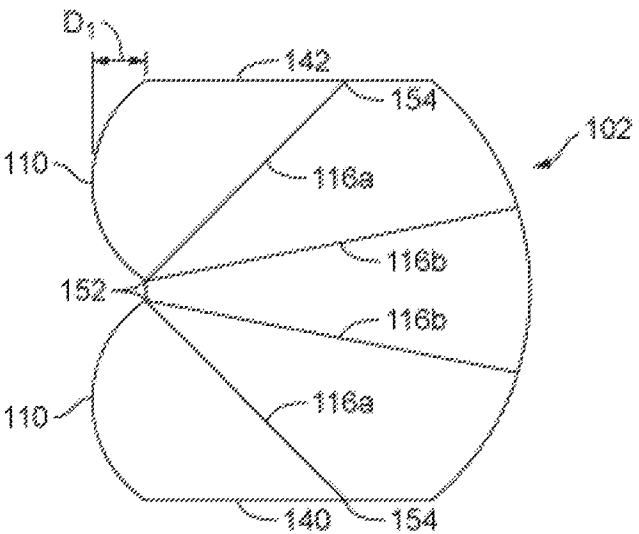

FIGS. 32A-32D illustrate advantages of a barless container liner systems comprising baffles disposed with substantially equal spacing across a rear bulkhead wall as compared to other container liner systems. FIG. 32A shows a plan or top cross-sectional view of container liner system, such as container liner 102, 200, 300, or 400 and is similar to the view shown in FIG. 5B. While the reference numbers for FIGS. 32A and 32B continue from FIG. 5B, the element numbers could likewise be those associated with container liners 102, 200, 300, 400, or other similar liner system. FIG. 32B shows an enlarged area of the portion of FIG. 32A indicated by section line "32B" and provides additional detail of a rear bulkhead wall 110. FIG. 32B also shows container liner 102 in a loaded condition in which a load contained within the container liner causes a displacement, deformation, or bulging of rear bulkhead wall 110. A tension applied to rear bulkhead wall 110 by baffles 116 at points along the rear bulkhead wall reduce the displacement of the rear bulkhead wall at the attachment points of baffles 116. A portion of rear bulkhead wall 110 achieves a maximum displacement or bulge D1 at approximately half-way between baffle 116 and right or left sidewall 140 or 142. In an embodiment in which container liner comprises a distance of approximately 11.6 meters between rear bulkhead wall 110 and forward bulkhead wall 144, the rear bulkhead wall is displaced a distance D1 of approximately 0.3 m.

Figure 32C:
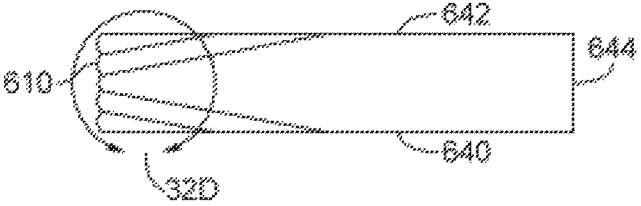
Figure 32D:
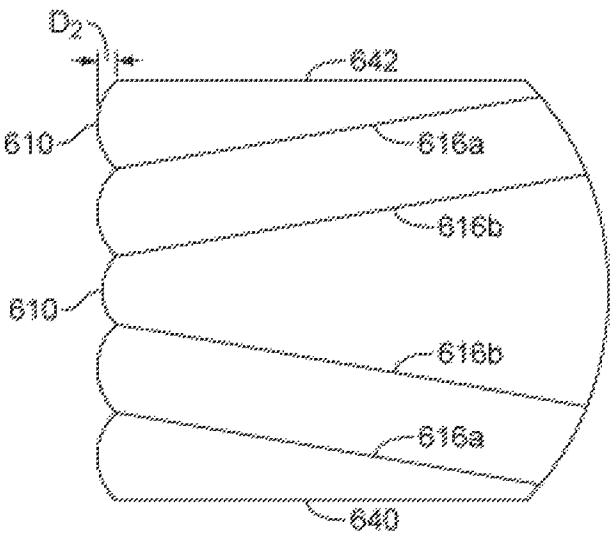

FIG. 32C shows a plan or top cross-sectional view of a container liner system, such as container liner 600, shown for example in FIG. 27. While the reference numbers for FIGS. 32C and 32D continue from FIG. 27, the element numbers could likewise be those associated with the container liners shown in FIGS. 33, 34, 35, 37, or other similar liner system. FIG. 32D shows an enlarged area of the portion of FIG. 32C indicated by section line "32D" and provides additional detail of rear bulkhead wall 610. FIG. 32D also shows container liner 600 in a loaded condition in which a load contained within the container liner causes a displacement, deformation, or bulging of rear bulkhead wall 610. A tension applied to rear bulkhead wall 610 by baffles 616 at points along the rear bulkhead wall reduce the displacement of the rear bulkhead wall at the attachment points of baffles 616. A portion of rear bulkhead wall 610 achieves a maximum displacement or bulge D2 at approximately half-way between multiple baffles 616 or approximately half-way between a baffle 616 and right or left sidewall 140 or 142. In an embodiment in which container liner 600 comprises a distance of approximately 11.6 meters between rear bulkhead wall 610 and forward bulkhead wall 644, the rear bulkhead wall is displaced a distance D2 of approximately 0.1 m. By more evenly distributing the contact between baffles 616 and rear bulkhead wall 610 across a width of the rear bulkhead wall, displacement of the rear bulkhead wall in FIG. 32D is less than the displacement of rear bulkhead wall 110 in FIG. 32B. In an embodiment, displacement D2 is approximately 0.2 m less than displacement D1. The alignment or configuration demonstrated in FIG. 32D is advantageous with respect to systems and apparatus with less evenly spaced baffles as shown in FIG. 32B for a number of reasons. First, more evenly spreading a plurality of baffles, such as four baffles 616, across a rear bulkhead wall strengthens the rear bulkhead wall for carrying loads. Second, as described with respect to FIGS. 32B and 32D, the spreading of baffles 616 across rear bulkhead wall 610 limits displacement of the rear bulkhead wall allowing for liner 600 to be formed with at least an additional 200 mm of length to the liner. The formation of liner 600 comprising additional length allows for a larger payload to be contained within the liner. Furthermore, the use of baffles 616 use less material than baffles 116, as described with respect to FIGS. 31A and 31B, which further reduces material cost.

Figure 33:
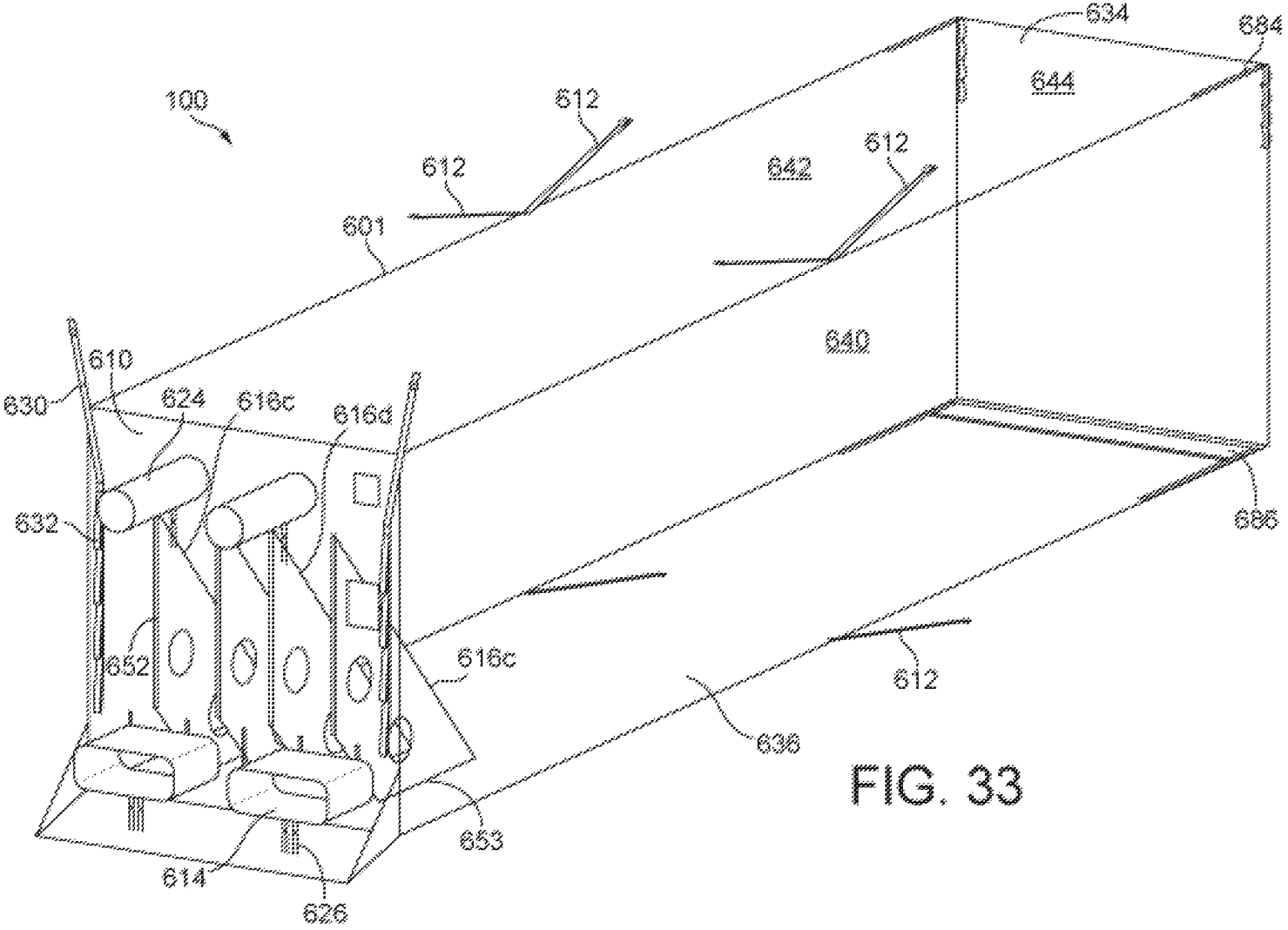
FIG. 33 shows another embodiment of a container liner system comprising four similarly sized back to bottom baffles.

FIG. 33 shows a transparent perspective view of an alternate container liner 601 as part of an embodiment of a container liner system 100 advantageous to baffles. Container liner 601 is similar to container liner 600 from FIGS. 27-30 and includes a rear bulkhead wall 610, an upper containment panel 634, a lower containment panel 636, and a forward containment wall 638 comprising right sidewall 640, left sidewall 642, and forward bulkhead 644. Container liner 601 further comprises tie-down straps 612. Rear bulkhead wall 610 can comprise one or more lower discharge chutes 614, internal baffles 616, upper fill chutes 624, chute ties 626, port covers 628, and looped bar straps 630 including bar support loops 632.

FIG. 33 further shows baffles 616 disposed within container liner 601 and placed at particular angles within the container liner. In an embodiment, internal baffles 616 are constructed from a durable material having suitable mechanical properties including appropriate tensile strength. Sometimes, for economy of construction, the material of internal baffles 616 comprises substantially the same flexible material used for the enveloping walls and bulkheads. A woven polypropylene material suitable for use in the construction of internal baffles 616 may comprise a material weight of about 95 gm per square meter. Typically, the material of upper fill chutes 624 and discharge chutes 614 are constructed from a similar woven polypropylene material comprising a material weight of about 95 gm per square meter. All strapping and webbing may comprise a heavy structural composition comprising woven flat webbing, such as but not limited to nylon webbing having a minimum width of about 25 mm.

FIG. 33 shows four separate baffles 616 coupled to rear bulkhead 610 of container liner 601 that may assist in distributing the weight of flowable material 108 more evenly than in the embodiments including container liners 102, 200, 300, and 400. By spreading the four baffles to four different places on rear bulkhead wall 610 of liner 601 with substantially equal spacing, a majority of the bulging of rear bulkhead wall 610 may be eliminated as discussed previously with respect to FIGS. 32A-32D. In a particular embodiment, container liner 601 comprises two outer baffles 616*c*, and two inner baffles 616*d*. Other embodiments may comprise additional baffles each coupled to rear bulkhead wall 610 at different points or planes. Outer baffles 616*c* and inner baffles 616*d* include rear attachment ends 652 that are coupled to rear bulkhead 610 similar to rear attachment ends 652 of baffles 616*a* and 616*b*. Outer baffles 616*c* and inner baffles 616*d* differ from outer baffles 616*a* and inner baffles 616*b* by comprising bottom attachment ends 653 that are coupled to lower containment panel 636 instead of comprising forward attachment ends 654 coupled to right and left sidewalls 640 and 642. Thus, in contrast to baffles 616*a* and 616*b*, baffles 616*c* and 616*d* of FIG. 33 are arranged in a "bottom to back" configuration in which baffles 616 spread across liner 601 and are substantially parallel with right sidewall 640 and left sidewall 642. By aligning baffles 616*c* and 616*d* substantially parallel with right and left sidewall 640 and 642, respectively, the baffles are in line with a natural front to back flow of flowable material 108 entering container liner 601 through upper fill chutes 624.

Placing baffles 616 in line with a natural front to back flow of flowable material 108 is desirable because as product is blown into a liner from back to front, baffles that are angled from rear bulkhead wall 610 to right and left sidewall 640 and 642 are sometime distorted as flowable material 108 reaches and contacts the baffles. The resultant deformation and movement of baffles 616 can lead to rear bulkhead 610 being pulled forward toward forward bulkhead 144, thereby reducing the space available within container liner 601 for flowable material 108. To the contrary, the in line configuration of baffles 616*c* and 616*d* allows flowable material 108 to enter container liner 601 through upper fill chutes 124 without distorting the baffles, thereby reducing movement of container liner 601 and allowing more of flowable material 108 to enter into the container liner. Furthermore, a size and orientation of baffles 616*c* and 616*d* provides a desired amount of reinforcement to container liner 601 without requiring the use of bars while still using less baffle material than in the configurations of container liners 102, 200, 300, and 400, thereby lowering both a cost of material and a cost in labor for forming baffles 616*c* and 616*d*.

Figure 34:
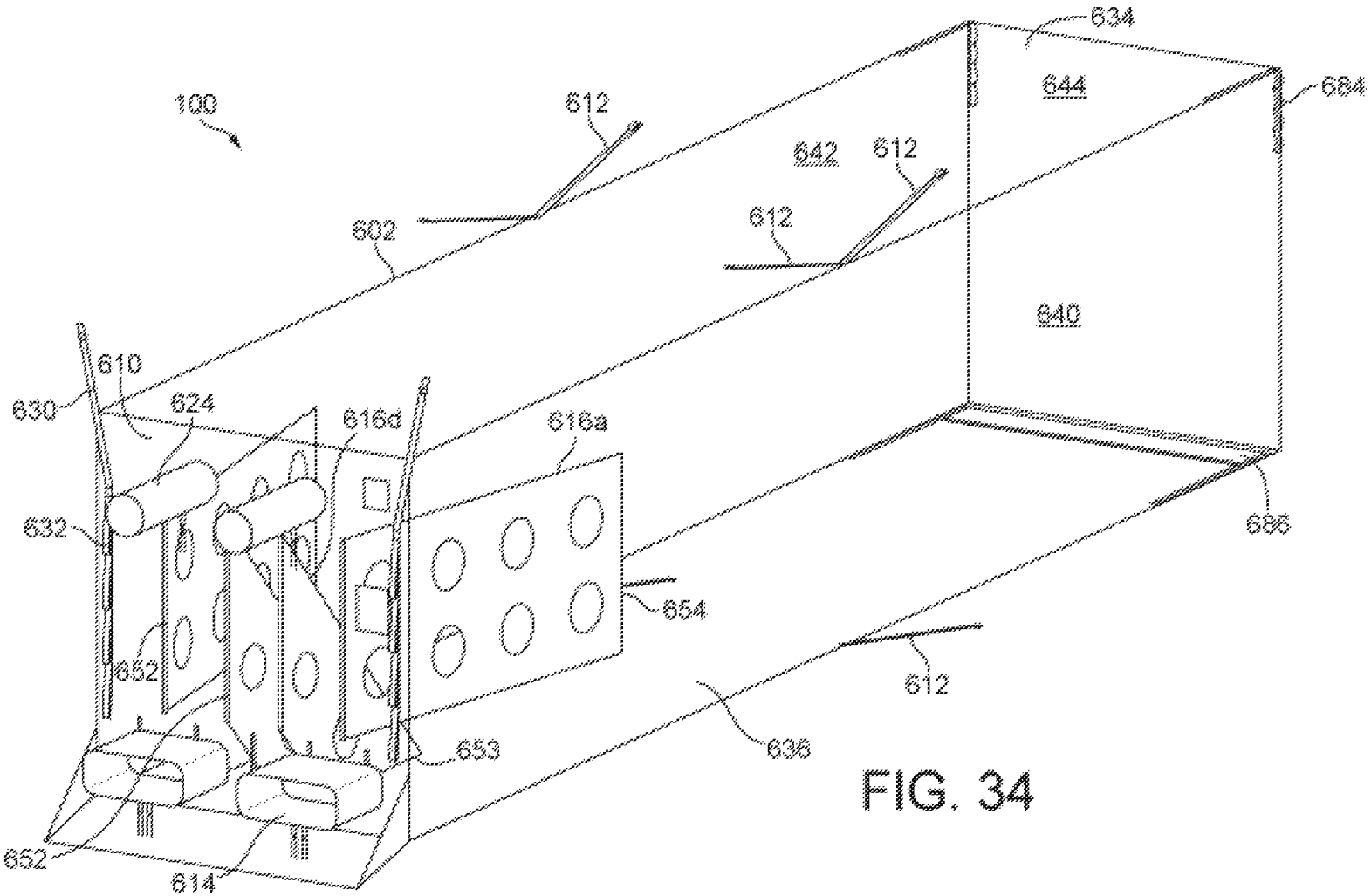
FIG. 34 shows another embodiment of a container liner system comprising two back to bottom baffles and two rectangular baffles.

FIG. 34 illustrates an alternate container liner 602 as part of an embodiment of a container liner system 100 advantageous to baffles. Container liner 602 comprises baffles 616*a* and 616*d*, thereby including features of both the embodiments illustrated in FIGS. 27 and 33. Baffles 616*a* and 616*d* in FIG. 34 are shown disposed at four separate locations that are substantially equally spaced across rear bulkhead wall 610 as described previously, for example, in relation to FIGS. 32A-32D, but can include any number of baffles at any number of locations substantially equally spaced across rear bulkhead wall 610. Thus, container liner 602 differs from container liners 600 and 601 by comprising baffles 616 coupled to both right and left sidewall 640 and 642 as well as to lower containment panel 636. By coupling baffles 616*a* and 616*d* to four different surfaces, that is rear bulkhead 610, right sidewall 640, left sidewall 642, and lower containment panel 636, overall strength of container liner system 100 is improved. Furthermore, because baffles 616*d* are most nearly aligned with upper fill chutes 124 and are parallel to a direction of flow of flowable material 108, deformation of baffles 616 resulting from contact with flowable material 108 during loading is also reduced.

As indicated above, any number of baffles including 616*a* and 616*d* can be coupled to rear bulkhead 610, right sidewall 640, left sidewall 642, and lower containment panel 636, to improve overall strength of container liner system 100. In an exemplary embodiment, five baffles are used such that four outer baffles 616*a* are coupled to rear bulkhead wall 610 with two outer baffles 616*a* being coupled to one or more locations on right sidewall 640 and two other outer baffles 616*a* are coupled to one or more locations on left sidewall 642. The fifth baffle 616 can be a back to bottom inner baffle such as 616*d* or 616*e* that is substantially parallel to right and left sidewalls 640 and 643.

Figure 35:
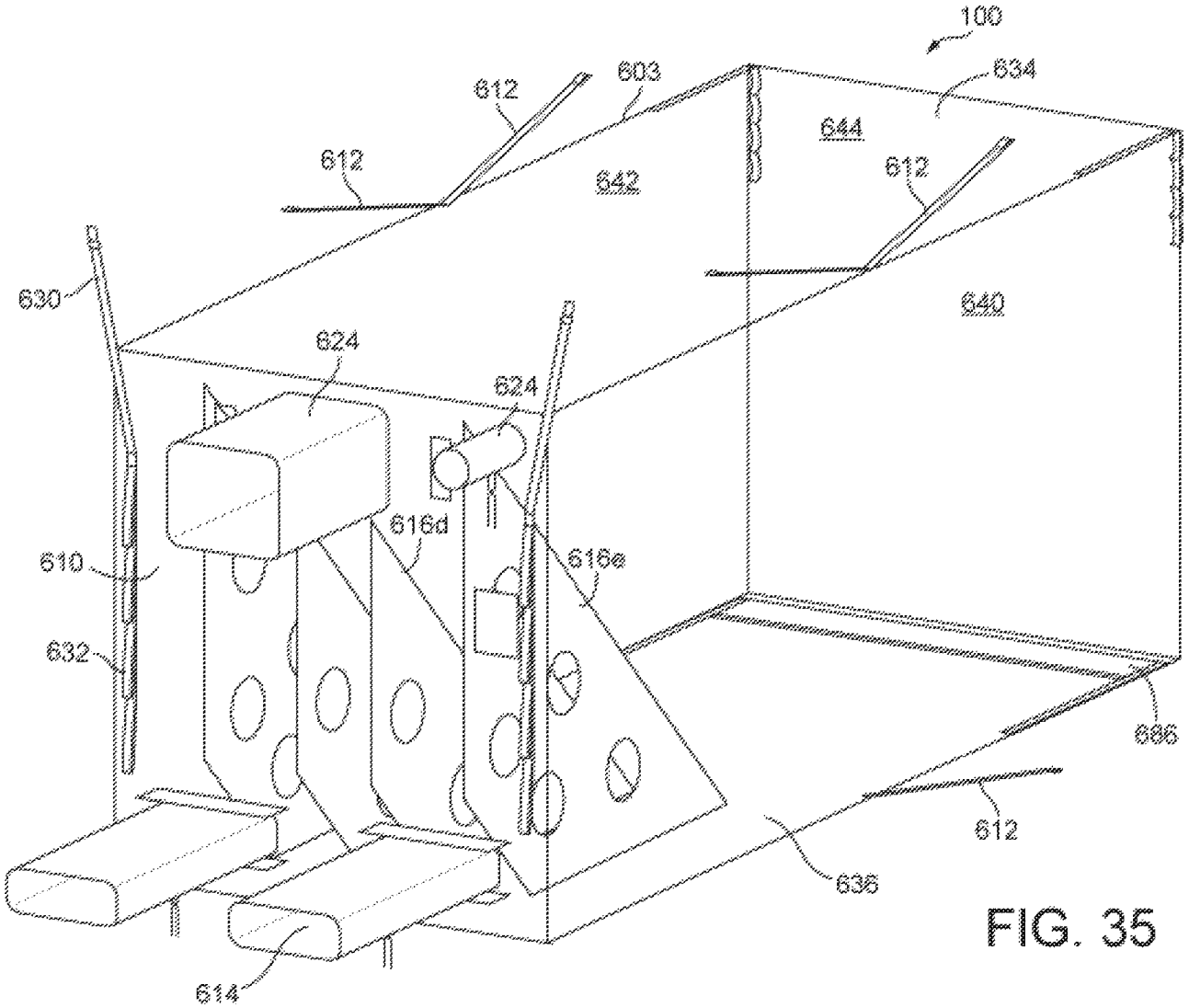
FIG. 35 shows another embodiment of a container liner system comprising four back to bottom baffles of two different sizes.

FIG. 35 illustrates an alternate container liner 603 as part of an embodiment of a container liner system 100 advantageous to baffles. The embodiment illustrated in FIG. 35, similar to container liner 601 in FIG. 33, shows four back to bottom baffles 616 distributed at substantially equidistant locations along rear bulkhead wall 110. Baffles 616 in container liner 603 comprise two outer baffles 616*e* having a first size and two inner baffles 616*d* comprising a second size smaller than the first size. Alternatively, inner baffles can be larger than the outer baffles. In yet another embodiment, four baffles 616*e* can be disposed in both the inner and outer baffle positions. Accordingly, a size and location of baffles 616 can be adjusted to accommodate particular needs for the loading, storage, transport, and unloading of flowable material 108. Advantageously, because baffles 616*d* and 616*e* are aligned with upper fill chutes 124 and are parallel to a direction of flow of flowable material 108, deformation of baffles 616 resulting from contact with flowable material 108 during loading is also reduced.

Figure 36B:
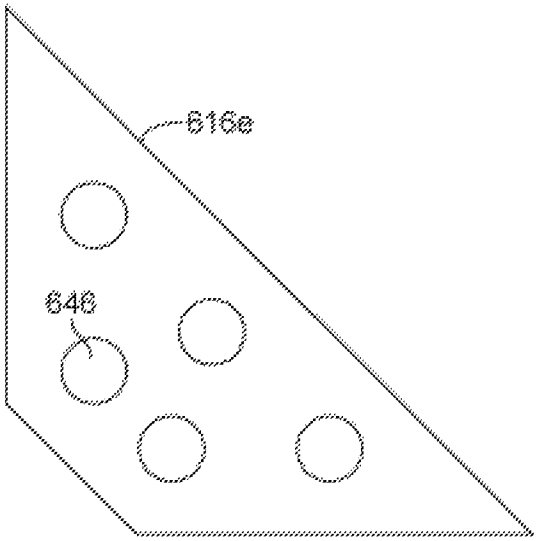
FIGS. 36A-36B show a comparison of different types of baffles.
Figure 36A:
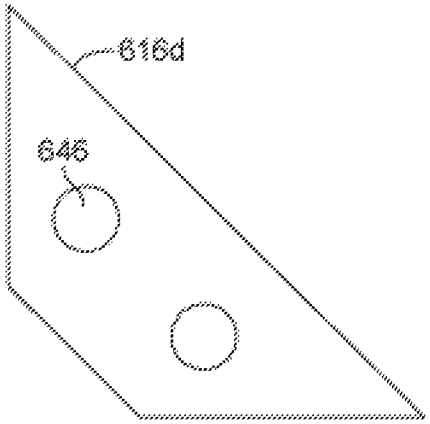

FIGS. 36A and 36B provide a comparison between smaller back to bottom baffle 616*d*, shown in FIG. 36A, and larger back to bottom baffle 616*e*, shown in FIG. 36B. The sizes of baffles 616*d* and 616*e* are both smaller than the baffles of FIG. 27. In a particular embodiment, smaller back to bottom baffles 616*d* comprise only two apertures 646, and larger back to bottom baffles 616*e* comprise only five apertures 646. All totaled, in particular embodiments, the material used for baffles 616*a* and 616*b* in FIG. 27 is sometimes nearly three times greater than the material used for the baffles in FIG. 33-35 (41 square meters to 14 square meters, respectively).

Figure 37:
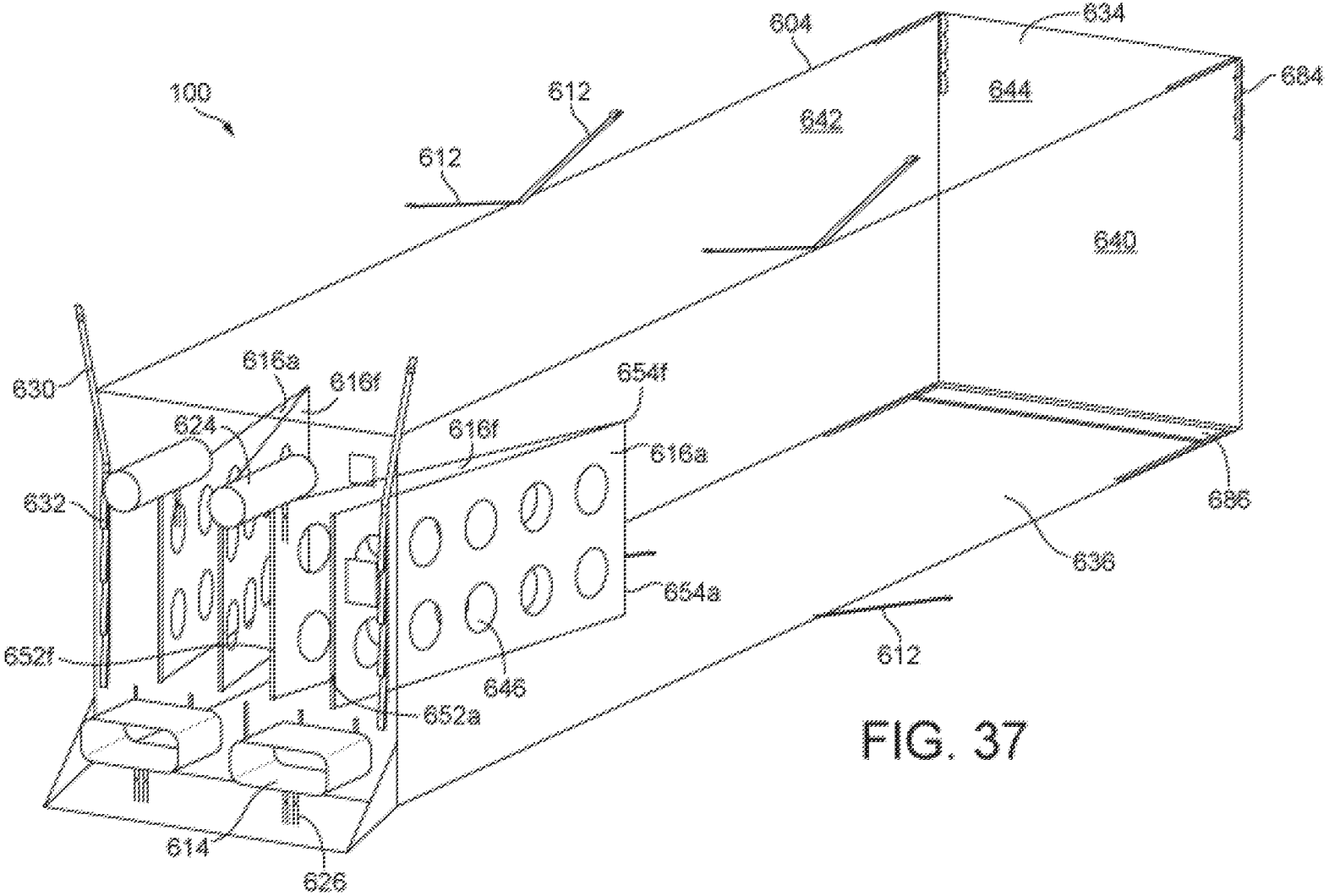
FIG. 37 shows another embodiment of a container liner system comprising two coupled sets of baffles.

FIG. 37 illustrates an alternate container liner 604 as part of an embodiment of a container liner system 100 advantageous to baffles. As shown in FIG. 37, baffles 616 comprise two outer baffles 616*a* that are substantially rectangular in shape and include a plurality of apertures 646. Baffles 616*a* include rear attachment end 652*a* coupled to rear bulkhead wall 610 and substantially evenly distributed across the rear bulkhead wall as described previously, for example, with respect to FIGS. 32C and 32D. Baffles 616*a* also include forward attachment ends 654*a* that are coupled to right and left sidewalls 140 and 142. Baffles 616 further comprise two inner baffles 616*f* that are substantially rectangular in shape and also include a plurality of apertures 646. Baffles 616*f* include rear attachment ends 652*f* that are coupled to rear bulkhead wall 610 and are substantially evenly distributed across the rear bulkhead wall with baffles 616*a* as described previously, for example, with respect to FIGS. 32C and 32D. Baffles 616*f* also include forward attachment ends 654*f* that are coupled to right and left sidewalls 640 and 642. In contrast to previously described embodiments, however, some of baffles 616 of the embodiment shown in FIG. 37 may be joined together, for example, at forward attachment ends 654*a* and 654*f* opposite rear bulkhead wall 610 before being coupled to right and left sidewalls 640 and 642. In an embodiment, first and second inner baffles 616*f* are coupled to separate first and second outer baffles 616*a*, respectively, such that the coupled inner and outer baffles are first coupled together and then subsequently coupled to right and left sidewalls 640 and 642. In other embodiments, first and second inner baffles 616*f* are coupled to separate first and second outer baffles 616*a*, respectively, at a same time that baffles 616*a* and 616*f* are coupled to right and left sidewalls 640 and 642. The coupling of forward attachment ends 654 may comprise at least two baffles coupled together through any coupling mechanism known in the art, or may alternatively comprise a single baffle bent or compressed so as to form a joint to couple the baffle to right and left sidewalls 640 and 642.

While the embodiment illustrated in FIG. 37 comprises rectangular baffles 616*a* and 616*f*, various embodiments may comprise any previously described baffle shape or design at a similar configuration. For example, an embodiment may comprise four back to bottom baffles similarly joined at two points opposite rear bulkhead wall 610. Alternatively, an embodiment may also comprise two rectangular outer baffles coupled to right and left side walls 640 and 642, and two back to bottom baffles joined together opposite rear bulkhead wall 610 of liner 604. In still other embodiments, a liner system may comprise two back to bottom outer baffles coupled to right and left side walls 640 and 642, and two rectangular inner baffles joined together opposite rear bulkhead wall 610 of liner 604.

Thus, it is demonstrated by the teachings of this specification that container liner system 100 is, by the present invention, adapted to transfer cargo loads from a rear bulkhead of the liner, to at least one mid-portion of the liner using a number of baffles or internal support panels. Furthermore, it is demonstrated by the teachings of this specification that container liner system 100 is adapted to transfer the cargo load from such mid-portions to a plurality of anchor points distributed along substantially the entire length of the shipping container, using a plurality of structural support members, typically a plurality of adjustable structural support members. Unloading of flowable material 108 from bulk material liners is often accomplished utilizing a discharge hopper. Discharge hoppers transport flowable material 108 from the discharge chute of a container liner to the material handling equipment of the delivery site.

Figure 17:
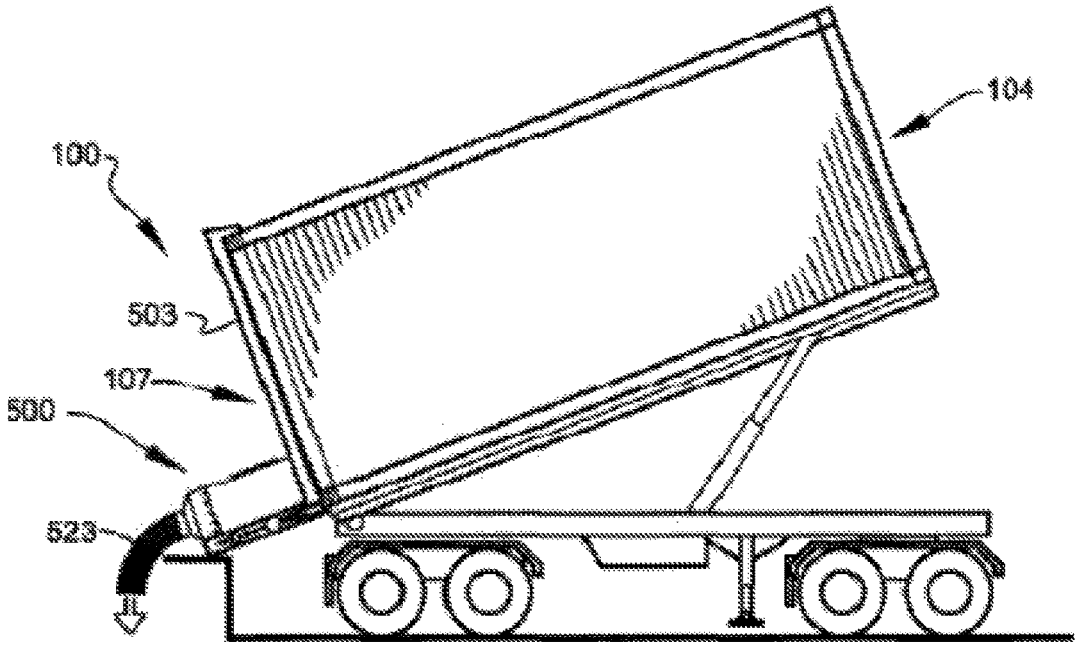
FIG. 17 shows a side view, in partial section, of a bulk-material discharge-hopper of the container liner system, according to an embodiment of a container liner system.

FIG. 17 shows a side view of bulk-material discharge hopper 500 of container liner system 100, according to an embodiment of the present invention. In an embodiment, bulk material discharge hopper 500 is adapted to maintain the liner discharge chutes in an optimal position within the hopper, thus reducing the chute's tendency to misshape or tear. Without the novel design arrangements of bulk-material discharge hopper 500, portions of the liner placed within the hopper are susceptible to wrinkling, folding, and tearing; a condition brought about, by uncontrolled and uneven pressure forces applied on the liner material during discharge. Such wrinkling, folding, and tearing of the liner slows the discharge process and can lead to contaminating the bulk material stream with torn liner material. The use of bulk material discharge hopper 500 substantially reduces problems associated with displacement of liner chutes within the hopper. Bulk-material discharge hopper 500 provides improved discharge performance in most compatible bulk liners. In addition, the unique configuration of bulk-material discharge hopper 500 takes full advantage of the increased discharge rate afforded by the use of the above described liner embodiments of container liner system 100. Bulk-material discharge hopper 500 may further operate in combination with special liner embodiments of container liner system 100, as described below.

In a particular embodiment, bulk-material discharge hopper 500 is mounted adjacent the lower rear opening 107 of shipping container 104. A temporary bulkhead 503 (generally not an element within the claimed embodiments of the present invention) provides a rigid structural framework that preferably overlays rear opening 107, as shown.

Figure 18:
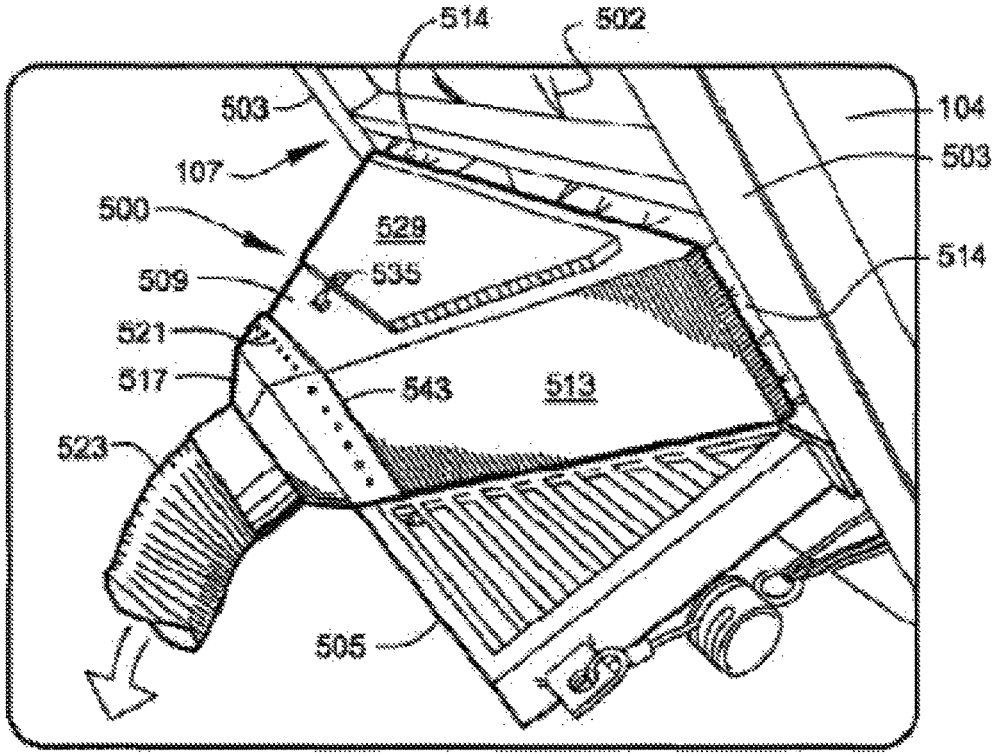
FIG. 18 shows a perspective view of the bulk-material discharge-hopper of FIG. 1.
Figure 20:
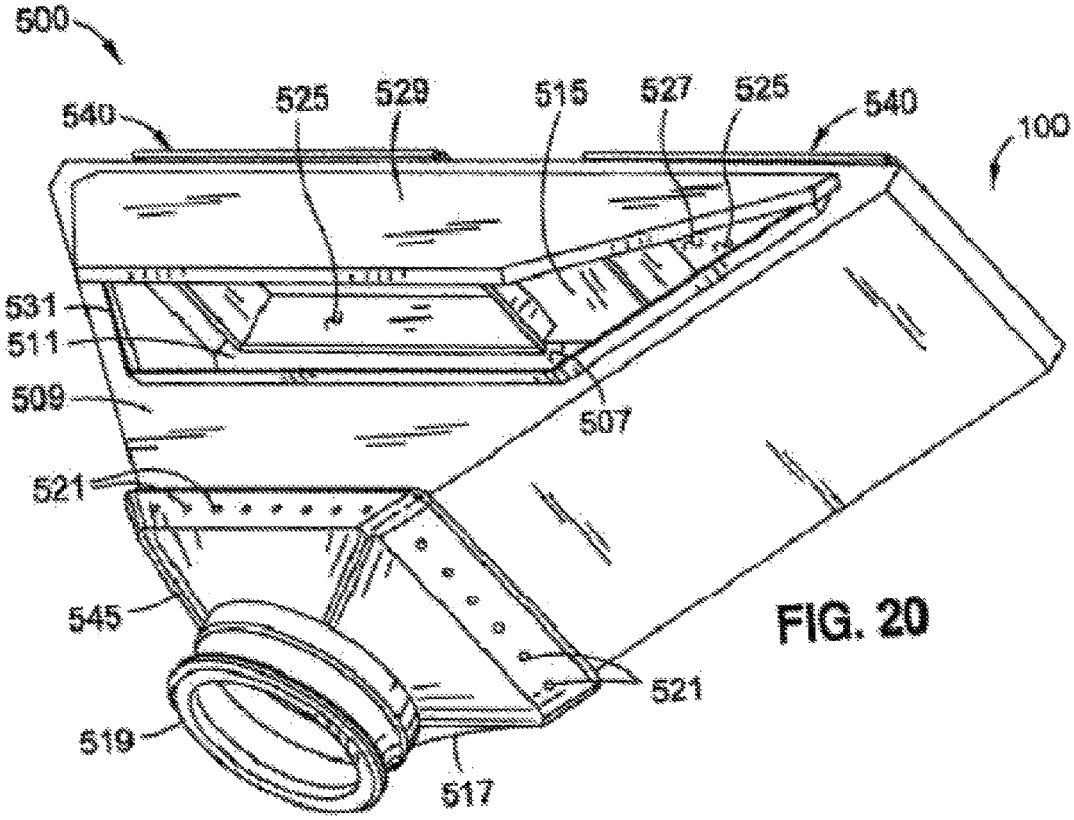
FIG. 20 shows a rear perspective view of the bulk material discharge-hopper of FIG. 1.

FIG. 18 shows a perspective view of temporary bulkhead 503 with the bulk-material discharge hopper 500 of FIG. 1 mounted adjacent the base of rear opening 107. In an embodiment, temporary bulkhead 503 comprises platform 505 projecting perpendicularly from the base of the bulkhead framework, as shown. Herein, temporary bulkhead 503 is adapted to support bulk-material discharge-hopper 500 in an operable position adjacent rear opening 107, as shown in FIG. 18. Bulk-material discharge-hopper 500 may be rigidly secured to the structural elements of platform 505, with the use of mechanical fasteners being preferred. When so secured, bulk-material discharge hopper 500 is located directly adjacent discharge chutes 514 of container liner 502, as shown. Bulk-material discharge hopper 500 comprises a rigid cabinet having a hollow interior 507 (see: FIG. 20). Bulk-material discharge hopper 500 may further comprise a funnel-like shape generally resembling a trapezoidal prism, as shown. Also, an arrangement of substantially planer outer walls encloses a hollow interior 507.

The outer walls of bulk-material discharge hopper 500 may comprise a generally trapezoidal-shaped upper wall 509 and a generally trapezoidal-shaped lower wall 511. In an embodiment, both upper and lower walls adjoin a pair of opposing rectangular sidewalks 513. In addition, bulk material discharge hopper 500 may comprise a generally rectangular forward wall 515 having a width extending substantially the entire width of rear opening 107, as shown. The relatively narrow discharge end of bulk-material discharge hopper 500 may comprise a generally rectangular discharge opening 543. Discharge opening 543 may be fitted with hose adapter 517 that transitions the preferred rectangular opening of discharge opening 543 to a substantially circular outlet 545.

In an embodiment, circular outlet 545 comprises hose coupler 51 adapted to couple bulk-material discharge hopper 500 to transfer hose 523. Transfer hose 523 functions to transfer the bulk material from bulk material discharge hopper 500 to the material handling equipment of the delivery site. Hose adapter 517 may be removably mounted to bulk-material discharge hopper 500 using a plurality of removable fasteners 521. This feature allows a single bulk-material discharge hopper 500 to be fitted with alternate site and/or equipment specific hose adapters 517. In operation, the interchangeability of hose adapters allows bulk material discharge hopper 500 to be modified to match the unloading requirements of a specific discharge site. Upon reading the teachings of this specification, those of ordinary skill in the art will now understand that, under appropriate circumstances, considering such issues as intended use, cost, etc., other mounting arrangements, such as, for example, utilizing a non-removable adapter, utilizing alternate and discharge shapes, utilizing power assist devices, etc., may suffice.

Figure 19:
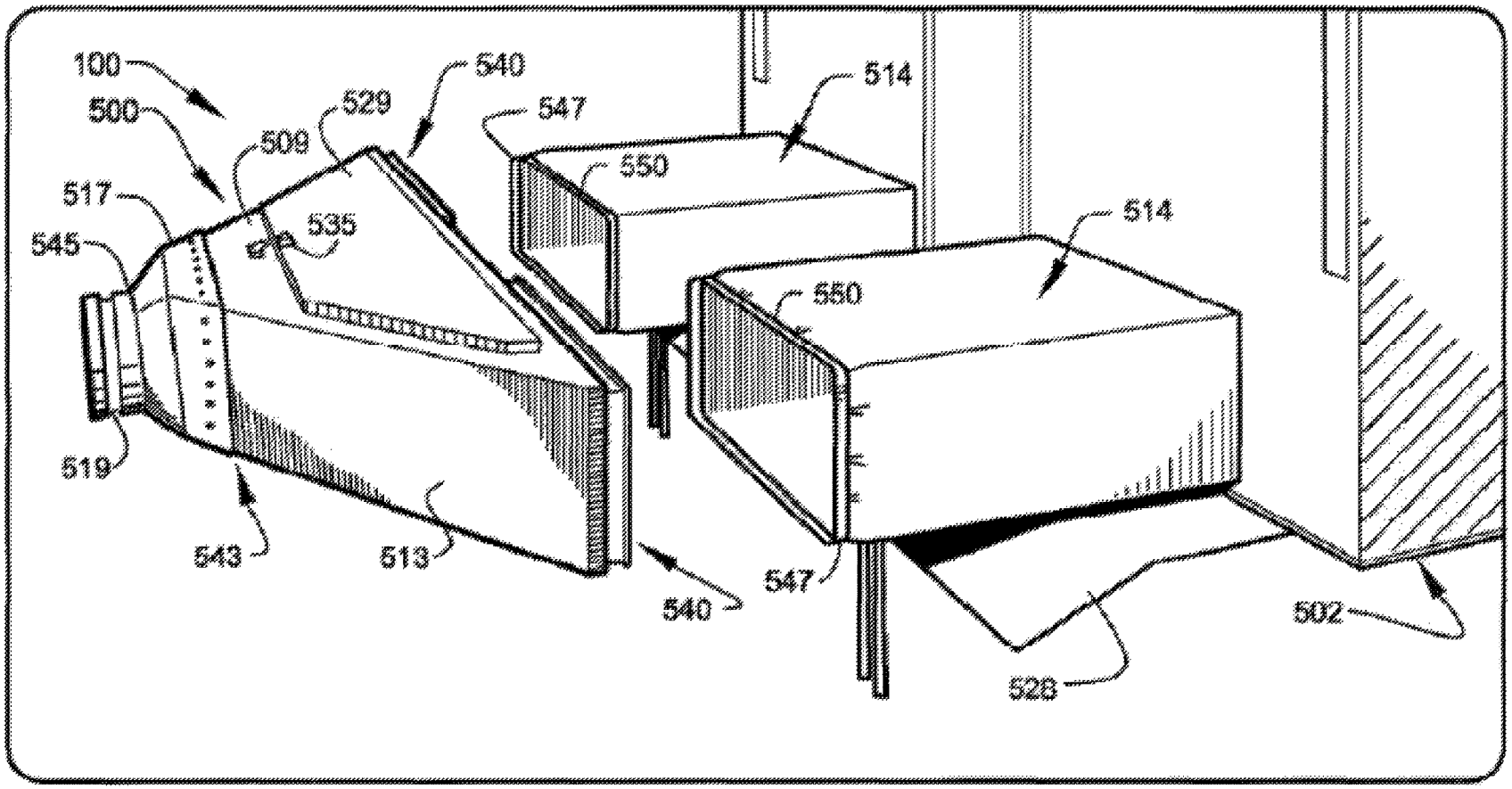
FIG. 19 shows a perspective view of the bulk-material discharge-hopper of FIG. 1 adjacent the discharge chutes of a container liner of a container liner system.
Figure 21:
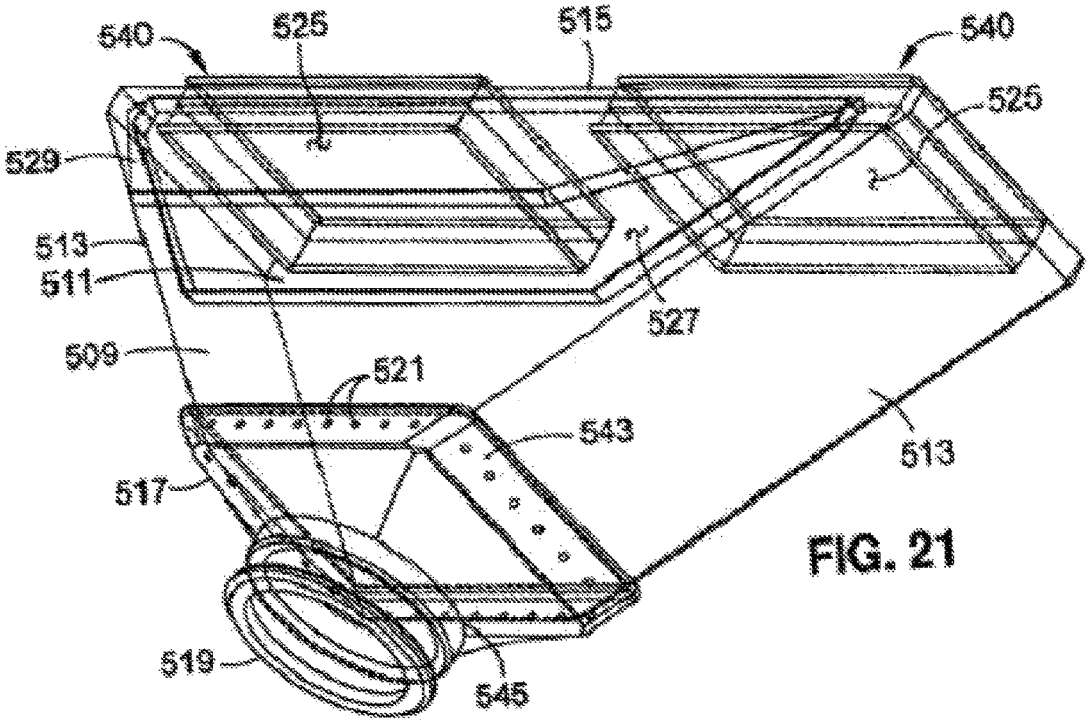
FIG. 21 shows a rear perspective view, of the bulk material discharge-hopper of FIG. 1, depicting internal component relationships, with selected external surfaces rendered partially transparent for clarity.

FIG. 19 shows a perspective view of bulk-material discharge-hopper 500 of FIG. 1 adjacent discharge chutes 514 of container liner 502 of container liner system 100. FIG. 20 shows a rear perspective view of bulk-material discharge hopper 500 of FIG. 1. FIG. 21 shows a 44 rear perspective view, of bulk-material discharge-hopper 500 of FIG. 1 depicting internal component relationships, with selected external surfaces rendered partially transparent for clarity.

Figure 22:
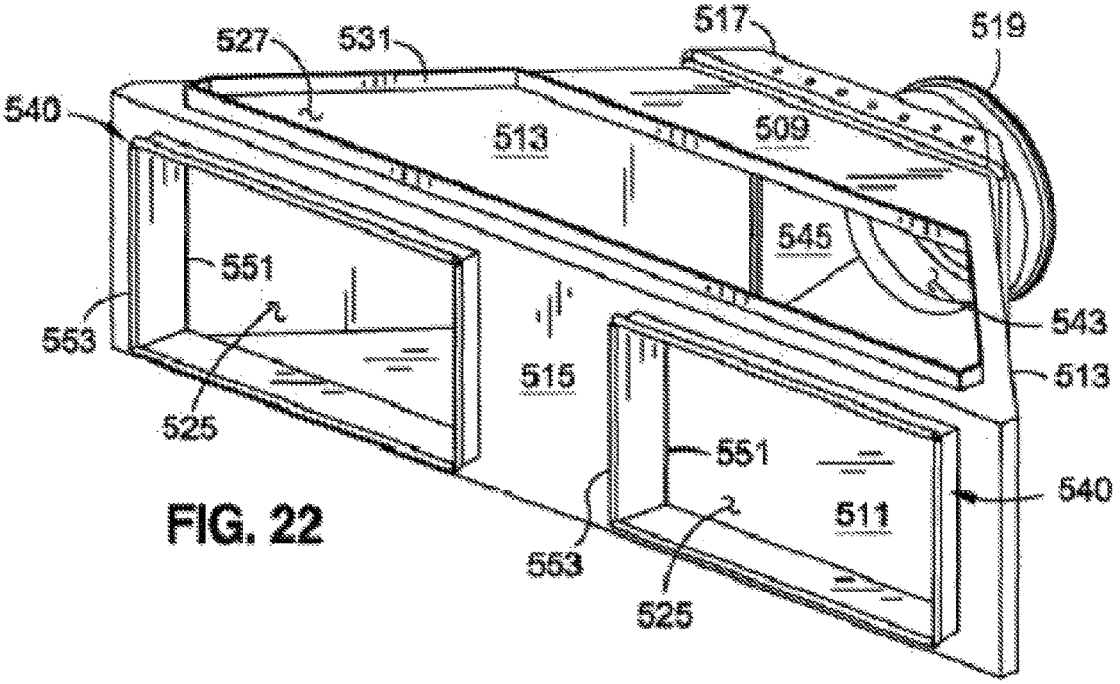
FIG. 22 shows a front perspective view of the bulk material discharge-hopper of FIG. 1.
Figure 23:
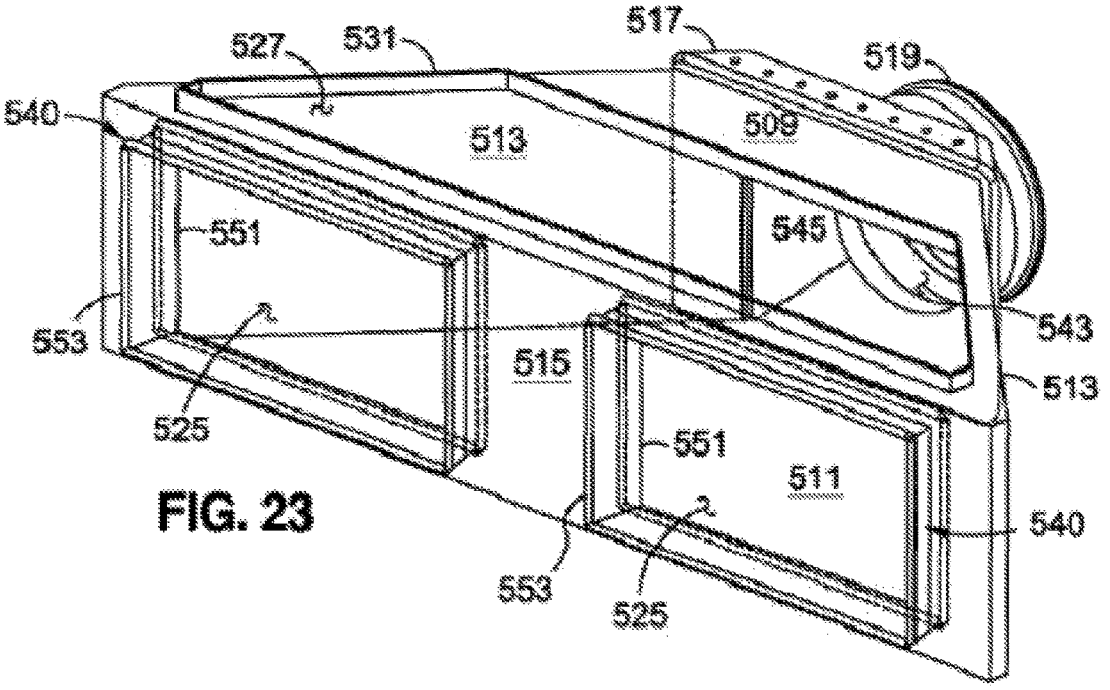
FIG. 23 shows a front perspective view, of the bulk material discharge-hopper of FIG. 1, depicting internal component relationships, with selected external surfaces rendered partially transparent for clarity.

FIG. 22 shows a front perspective view of bulk material discharge hopper 500 of FIG. 1. FIG. 23 shows a front perspective view, of bulk-material discharge hopper 500 of FIG. 1, depicting internal component relationships, with selected external surfaces rendered partially transparent for clarity.

Reference is now made to FIG. 19 through FIG. 23 with continued reference to FIG. 17 and FIG. 18. In an embodiment bulk-material discharge-hopper 500 comprises at least one, and typically two forward apertures 525, as shown. Each aperture is structured and arranged to receive one of the two discharge chutes 514 of container liner 502, as shown. This arrangement allows the discharge chutes to deliver the bulk material to hollow interior 507. Each aperture 525 generally comprises a rectangular shape and size generally matching that of the discharge chutes 514, as shown. In an embodiment, both apertures 525 are substantially symmetrical in design, with each aperture 525 comprising a substantially continuous peripheral flange assembly 540 that projects inward and outward from forward wall 515.

Access to interior 507 is provided through a single large access opening 527 located within upper wall 509, as shown. A continuous peripheral flange 531 projects upward from the periphery of opening 527, adding rigidity to upper wall 509 and functioning as a sealing surface adjacent the corresponding peripheral flange of hinged cover 529, (for clarity in illustrating internal components of the hopper, hinged cover 529 is omitted from the views of FIG. 22 and FIG. 23). In an embodiment, hinged cover 529 is configured to seal 45 opening 527 during material discharge. Hand operable latch 535 maintains hinged cover 529 in the closed position depicted in FIG. 18, and releases hinged cover 529 allowing the cover to pivot upward for internal access. Upon reading the teachings of this specification, those of ordinary skill in the art will now understand that, under appropriate circumstances, considering such issues as intended use, size of hopper, etc., other access arrangements, such as, for example, sliding panels, multiple ports, removable covers, etc, may suffice.

In an embodiment, bulk-material discharge-hopper 500 is constructed from a substantially rigid material. For durability, bulk-material discharge-hopper 500 is constructed predominantly from steel. Upon reading the teachings of this specification, those of ordinary skill in the art will now understand that, under appropriate circumstances, considering such issues as intended use, cost, etc., other material arrangements, such as, for example, the use of plastics, fiberglass, composite materials, etc., may suffice.

Figure 24:
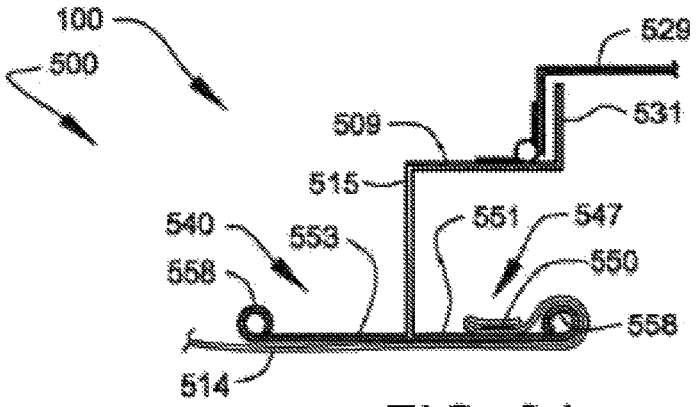
FIG. 24 shows a sectional view through a section taken through the upper flange assembly of a chute inlet, illustrating attachment of the container liner according to an embodiment of a container liner system.

FIG. 24 shows a sectional view through a section taken through the upper portion of peripheral flange assembly 540 of a chute inlet aperture 525, illustrating attachment of the container liner according to an embodiment.

Reference is now made to FIG. 24 with continued reference to FIG. 19. FIG. 19 illustrates alternate container liner 502 comprising a pair of modified discharge chutes 514, as shown. In an embodiment, the distal end 547 of each modified discharge chute 514 comprises elastic banding 550 adapted to secure distal end 547 to peripheral flange assembly 540 of bulk-material discharge-hopper 500. More specifically, distal end 547 of discharge chute 514 is inserted through aperture 525 and is firmly secured to interior inner flange section 551 of peripheral flange assembly 540 using elastic banding 550.

Discharge chute 514 is maintained in an optimal position by the physical restraint applied by inner flange section 551. Elastic-banding 550 extends circumferentially around distal end 547 of the chute. In an embodiment, elastic-banding 550 is permanently joined to distal end 547. Elastic-banding 550 may be sewn to the surface of distal end 547. Alternately, elastic-banding 550 is captured within an edge casing. The casing is permanently formed by thermal bonding (such as ultrasonic welding) or by mechanical sewing (using a straight stitch or serge-type seaming). Upon reading the teachings of this specification, those of ordinary skill in the art will now understand that, under appropriate circumstances, considering such issues as intended use, cost, nature and liner material, etc., other attachment arrangements, such as, for example, drawstrings, detached elastic bands provided with the liner, "tensionable" circumferential bands, cord ties, "bungee" cords, hooks with corresponding islets, cohesive surfaces, adhesive-backed tapes, elastic bands surface bonded to the chute, hook and loop bands, etc., may suffice. Each discharge chute 514 may comprise a length somewhat longer than the prior chute embodiments to allow the above described securing to peripheral flange assembly 540.

Figure 25:
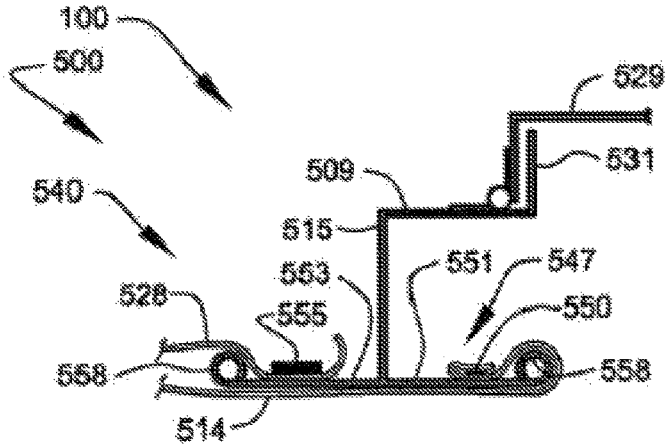
FIG. 25 shows a similar sectional view through a section taken through the upper flange assembly of a chute inlet, illustrating attachment of the container liner according to an embodiment of a container liner system.

FIG. 24 illustrates the preferred attachment of discharge chute 514 to inner flange section 551 of the peripheral flange assembly 540. FIG. 25 shows a similar sectional view through the upper portion of peripheral flange assembly 540, illustrating attachment of both discharge chutes 514 and port covers 528 to peripheral flange assemblies 540, according to another embodiment of the present disclosure. In a particular installation of FIG. 25, port cover 528 is secured to outer flange section 553 of peripheral flange assembly 540 using elastic band 555 extending circumferentially around outer flange section 553, as shown. The securing of port cover 528 to peripheral flange assembly 540 further assists in maintaining discharge chutes 514 in an optimal configuration during discharge.

Figure 26:
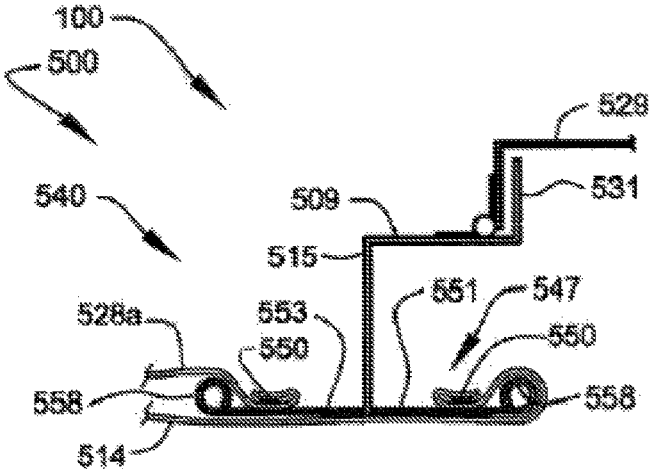
FIG. 26 shows an additional sectional view through a section taken through the upper flange assembly of a chute inlet, illustrating attachment of the container liner according to an embodiment of a container liner system.

FIG. 26 shows an additional sectional view through a section taken through the upper flange assembly of a chute inlet, illustrating attachment of the container liner according to another embodiment of the present invention. In the embodiment of FIG. 26, port covers 528*a* have been further modified to comprise elastic-banding 550. In the preferred embodiment, each port cover 528*a* comprises a substantially continuous sleeve extending around its associated discharge chute 514. Elastic-banding 550 extends circumferentially around the distal end of port cover 528*a*.

In an embodiment, elastic-banding 550 is permanently joined to distal end 54. Elastic-banding 550 may be sewn to the surface of port covers 528*a* in a manner similar to that of discharge chutes 514. Alternately, elastic banding 550 may be coupled by capture within an edge casing, as shown. Such casing is permanently formed by thermal bonding or by mechanical sewing.

Inner flange section 551 may project inwardly from forward wall 515 a distance of about 50 mm, as shown. Outer flange section 553 may project outwardly from forward wall 515 an equivalent distance of about 50 mm. The tendency of the chute material to tear by passing adjacent peripheral flange assembly 540 is reduced by addition of a smoothly transitioning terminal edge 558 along the periphery of both inner flange section 551 and outer flange section 553.

Figure 38:
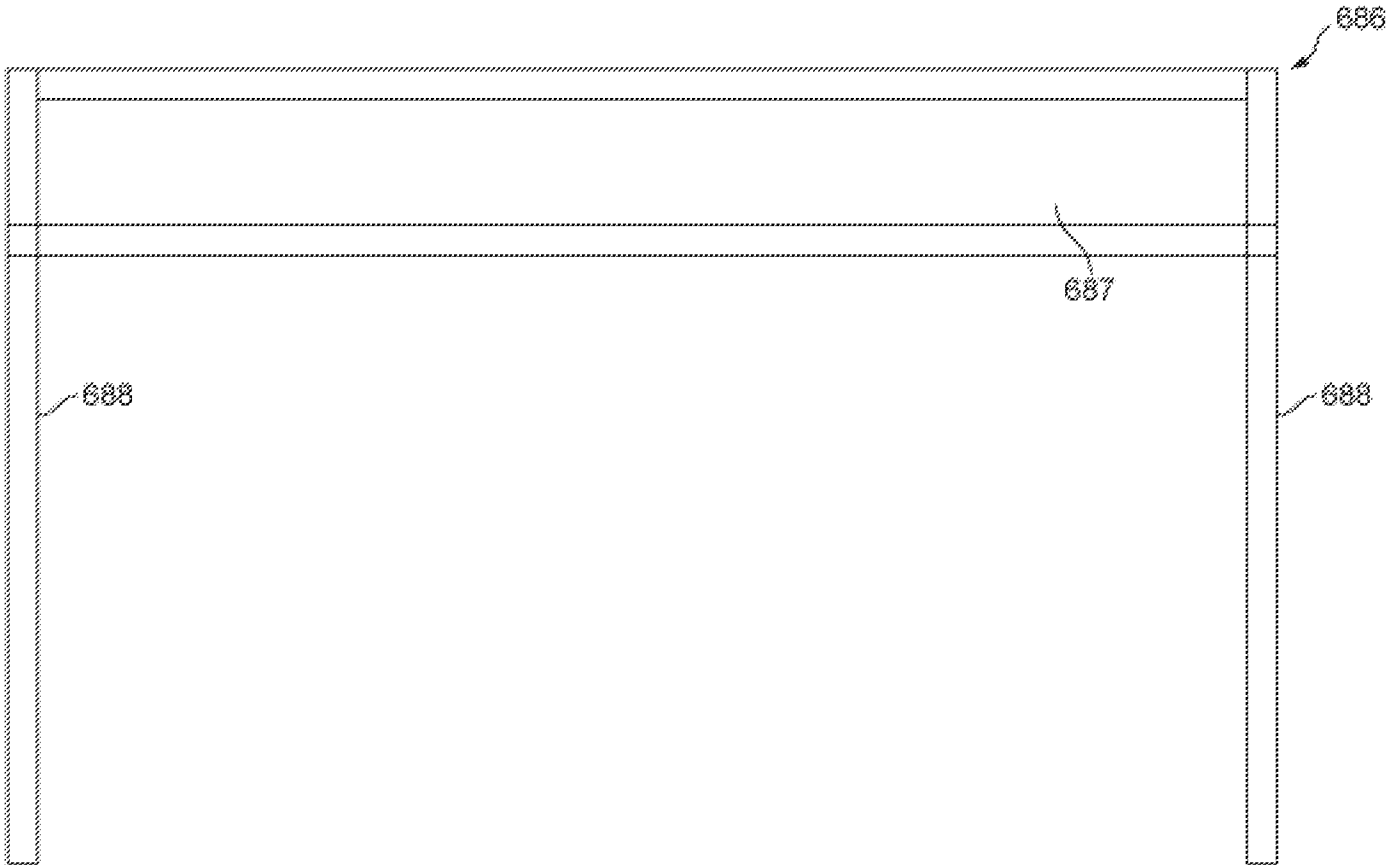
FIG. 38 shows a perspective view a cross strap and a cross strap in place in a container liner system.

Referring now to FIGS. 27, 38, and 39, an embodiment of the container liner system may further comprise a cross strap 686. FIG. 27 illustrates an exemplary placement of cross strap 686, while FIG. 38 provides a more detailed view of the cross strap. Cross strap 686 may be situated near forward bulkhead 644, as shown in FIG. 27, or may alternatively be disposed near rear bulkhead wall 610 of container liner system 100. In a particular embodiment, cross strap 686 may be sewn to side straps 688 through the sleeve 687, thus providing improved weight distribution and an alternative to using a steel bar. In another embodiment, a steel bar can be disposed or fit within sleeve 687 and used in conjunction with cross strap 686. In other embodiments, cross strap 686 may alternatively be coupled to side straps 688 through a variety of mechanisms and in a variety of locations. The material of cross strap 686 may be similar to the material of straps 112 and 612 previously described. In an embodiment, side straps 688 can comprise a length in a range of approximately 1-2 m and more preferably about 1.5 m, and are separated from one another by a length of sleeve 687 or a distance of approximately 2-2.5 m, or more preferably approximately 2.28-2.4 m. Side straps 688 can be aligned with right and left sidewalls 640 and 643, and as such can have a width between outer edges of approximately 2.4 m. Sleeve 687 can have a width transverse to its length in a range of 0.2-0.4 m, or more preferably about 0.3 m.

Figure 39B:
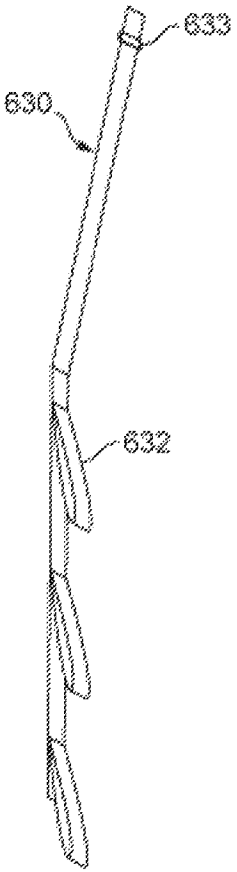
FIGS. 39A-39C show various side profile views of another embodiment of a container liner system strap.
Figure 39A:
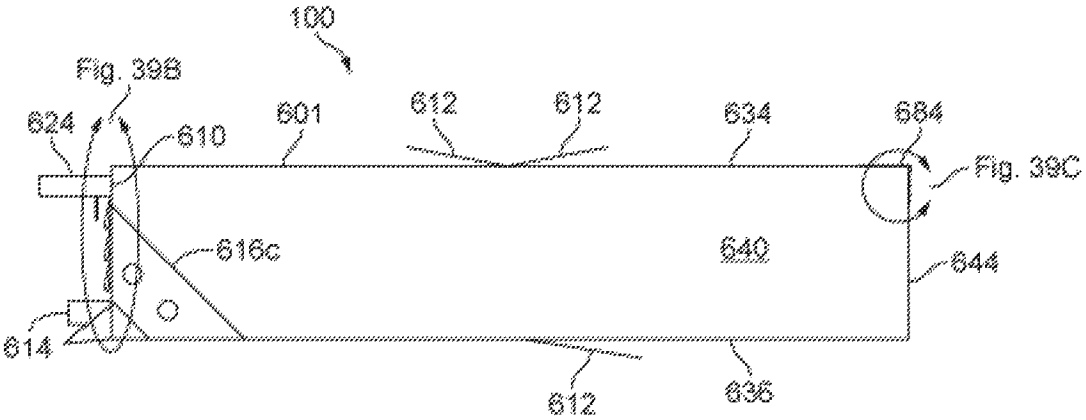

FIG. 39A shows a cross-sectional side view of container liner 601 from FIG. 33. FIG. 39A further identifies back strap 630 disposed on a portion of rear bulkhead wall 610 shown in greater detail in FIG. 39B, and strap 684 disposed on a portion of front bulkhead wall 644 and upper containment wall 634 shown in greater detail in FIG. 39C.

As illustrated in FIG. 39B, various embodiments may comprise back straps 630 that differ from looped bar straps 130 and rear tie-straps 131 by utilizing one continuous piece of strap material. Back straps 630 may further comprise bar support loops 632, similar to bar support loops 132 of looped bar straps 130. Back straps 630 may also comprise at least one O-ring 633 for length control and for receiving at least one snap hook (not shown). Bar straps 630, including support loops 632 and O-ring 633 provide additional strength to the container liner system, and increase ease of installation of a container liner within a shipping container 104.

Figure 39C:
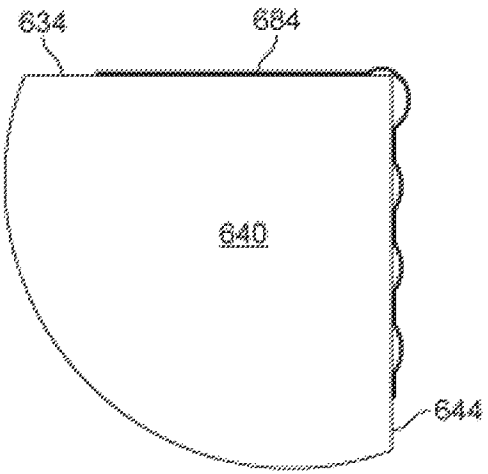

FIG. 39C shows an upper front side-strap 684 coupled to forward bulkhead wall 644 and to upper containment panel 634. Strap 684 as shown in the embodiment of FIG. 39C is lengthened in comparison to support strap 184 shown in FIG. 9. By coupling or fastening upper front side-strap 684 to both forward bulkhead wall 644 and to upper containment panel 634, additional strength is provided to container liner system 100. In an embodiment, strap 684 extends a length of approximately 0.5 m across upper containment panel 634 and a length of approximately 0.6 m across forward bulkhead wall 644.

Upon reading the teachings of this specification, those of ordinary skill in the art will now understand that, under appropriate circumstances, considering such issues as intended use, advances in discharge technology, etc., other discharge chute arrangements, such as, for example, using a single large chute, incorporating shape-holding structures etc, may suffice. Although applicant has described applicant's preferred embodiments of this invention, it will be understood that the broadest scope of this invention includes modifications such as diverse shapes, sizes, and materials. Such scope is limited only by the below claims as read in connection with the above specification, further, many other advantages of applicant's invention will be apparent to those skilled in the art from the above descriptions and the attached claims.

Having herein set forth the various embodiments of the present invention, it is anticipated that suitable modifications can be made thereto which will nonetheless remain within the scope of the invention. The invention shall therefore only be construed in accordance with the following claims below.

What is claimed is:

1. A system for containing and controlling a flowable material within the interior of a cargo container, the system comprising:

a separating enclosure adapted to separately enclose substantially an entire volume of an interior of the cargo container, the separating enclosure comprising an interior chamber adapted to contain the flowable material within the separating enclosure, wherein the interior chamber comprises a substantially vertical rear-boundary wall, a substantially vertical front-boundary wall, a substantially vertical first sidewall, a substantially vertical second sidewall, and a deflection limiter;

at least four tension adjustable strap assemblies, each of the at least four tension adjustable strap assemblies comprising a tensioner member coupled to a strap, a section of the strap coupled to an upper portion of the separating enclosure, and an end portion of the strap coupled to an anchor adapted to removably attach the separating enclosure to the interior of the cargo container, wherein the at least four tension adjustable strap assemblies are adapted to transfer a discharging load of the flowable material between the separating enclosure and the cargo container; and a cross strap assembly comprising:

a cross strap coupled near the front-boundary wall, the front-boundary wall being positioned opposite the rear-boundary wall;

a first side strap coupled to a substantially horizontal bottom sidewall along a portion of the substantially vertical first sidewall;

a second side strap coupled to the substantially horizontal bottom sidewall along a portion of the substantially vertical second sidewall, the substantially vertical second sidewall being opposite the substantially vertical first sidewall, wherein the first and second side straps are coupled to the cross strap;

wherein the deflection limiter is adapted to limit deflection of the substantially vertical rear-boundary wall under a load imposed by the flowable material during containment within the separating enclosure and further adapted to guide flowable material towards a center of the substantially vertical rear-boundary wall during discharge; and wherein the deflection limiter comprises at least four load transfer members coupled to the substantially vertical rear-boundary wall at four separated locations, the at least four load transfer members each comprising a first member side coupled to the substantially vertical rear-boundary wall, a second member side, and at least a third member side, each of the first member sides of the at least four load transfer members coupling to the substantially vertical rear-boundary wall at a separate location.

2. The system of claim 1, wherein the at least four load transfer members comprise two inner load transfer members and two outer load transfer members, the two inner load transfer members coupled to the substantially vertical rear-boundary wall at two separate locations between the two outer load transfer members.

3. The system of claim 2, wherein:

a first outer load transfer member of the two outer load transfer members is coupled to the substantially vertical first sidewall;

a first inner load transfer member of the two inner load transfer members is coupled to the substantially vertical first sidewall;

a second outer load transfer member of the two outer load transfer members is coupled to the substantially vertical second sidewall; and a second inner load transfer member of the two inner load transfer members is coupled to the substantially vertical second sidewall.

4. The system of claim 3, wherein:

the first inner load transfer member and the first outer load transfer member are coupled to the substantially vertical first sidewall at different locations; and the second inner load transfer member and the second outer load transfer member are coupled to the substantially vertical second sidewall at different locations.

5. The system of claim 1, wherein each of the at least four load transfer members is substantially rectangular in shape.

6. The system of claim 1, wherein at least two of the at least four load transfer members are substantially trapezoidal in shape and comprise a first member side, a second member side, a third side, and a fourth side parallel to the third side, wherein the first member side is not parallel to the second member side.

7. The system of claim 6, wherein:

four of the at least four load transfer members are substantially trapezoid in shape and comprise a first member side, a second member side, a third side, and a fourth side parallel to the third side, wherein the first member side is not parallel to the second member side; and the second member side of each of the at least four load transfer member contacts the substantially horizontal bottom sidewall of the interior chamber.

8. The system of claim 1, wherein each of the four load transfer members is substantially perpendicular to the rear-boundary wall.

9. The system of claim 2, wherein:

the two inner load transfer members are substantially trapezoidal in shape;

a first member side of each of the inner load transfer members is coupled to the substantially vertical rear-boundary wall;

a second member side of each of the inner load transfer members contact the substantially horizontal bottom sidewall of the interior chamber; and the two outer load transfer members are substantially rectangular in shape.

10. The system of claim 2, wherein the two inner load transfer members are smaller in size relative to the two outer load transfer members.

11. The system of claim 2, wherein:

a second member side of a first inner load transfer member of the two inner load transfer members is connected to a second member side of a first outer load transfer member of the two outer load transfer members; and a second member side of a second inner load transfer member of the two inner load transfer members is connected to a second member side of a second outer load transfer member of the two outer load transfer members.

12. The system of claim 11, wherein:

the first inner load transfer member and the first outer load transfer member are further coupled to the first sidewall; and the second inner load transfer member and the second outer load transfer member are further coupled to the second sidewall.

13. A system for containing and controlling a flowable material within the interior of a cargo container, the system comprising:

a separating enclosure adapted to substantially enclose an entire volume of an interior of the cargo container;

at least four load transfer members, each of the at least four load transfer members including a first end coupled along a width of a substantially vertical rear-boundary wall and comprising substantially equal spacing between each of the first ends;

at least four tension adjustable strap assemblies, each of the at least four tension adjustable strap assemblies comprising a tensioner member coupled to a strap, a section of the strap coupled to an upper portion of the separating enclosure, and an end portion of the strap coupled to an anchor adapted to removably attach the separating enclosure to the interior of the cargo container, wherein the at least four tension adjustable strap assemblies are adapted to transfer a discharging load of the flowable material between the separating enclosure and the cargo container; and a cross strap assembly comprising:

a cross strap coupled near a front-boundary wall, the front-boundary wall being positioned opposite the rear-boundary wall;

a first side strap coupled to a substantially horizontal bottom sidewall along a portion of a substantially vertical first sidewall;

a second side strap coupled to the substantially horizontal bottom sidewall along a portion of a substantially vertical second sidewall, the substantially vertical second sidewall being opposite the substantially vertical first sidewall, wherein the first and second side straps are coupled to the cross strap.

14. The system of claim 13, wherein the at least four load transfer members limit deflection of the rear-boundary wall to less than about 0.2 meters.

15. The system of claim 13, wherein each of the at least four load transfer members comprises a second end opposite the first end, each second end coupling to the separating enclosure at the substantially vertical first sidewall, the substantially vertical second sidewall, or the substantially horizontal bottom sidewall.

16. The system of claim 15, wherein each of the at least four load transfer members comprises a substantially rectangular profile and contacts no more than two boundary walls when containing and controlling the flowable material.

17. The system of claim 13, wherein two of the at least four load transfer members comprise two outer load transfer members comprising second ends coupled to the substantially horizontal bottom sidewall.

18. The system of claim 13, further comprising a back strap comprising support loops coupled to the rear-boundary wall.

19. The system of claim 13, further comprising a strap comprising support loops coupled to a substantially horizontal upper containment panel and coupled to the front-boundary wall opposite the rear-boundary wall.

20. The system of claim 13, wherein the cross strap comprises a sleeve.

* * * * *